US012495866B2

(12) United States Patent
Hopkins et al.

(10) Patent No.: US 12,495,866 B2
(45) Date of Patent: Dec. 16, 2025

(54) FOOTWEAR ARTICLE WITH COLLAR ELEVATOR

(71) Applicant: Nike, Inc., Beaverton, OR (US)

(72) Inventors: Timothy P. Hopkins, Tustin, CA (US); Austin J. Orand, Portland, OR (US); Aaron B. Weast, Portland, OR (US); Peter P. Williams, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/096,381

(22) Filed: Jan. 12, 2023

(65) Prior Publication Data

US 2023/0165339 A1 Jun. 1, 2023

Related U.S. Application Data

(62) Division of application No. 16/725,754, filed on Dec. 23, 2019, now abandoned.

(60) Provisional application No. 62/785,969, filed on Dec. 28, 2018.

(51) Int. Cl.
*A43B 21/32* (2006.01)

(52) U.S. Cl.
CPC ..... *A43B 21/32* (2013.01)

(58) Field of Classification Search
CPC ..... A43B 21/32; A43B 21/36; A43B 23/088; A43D 11/00
USPC ..... 12/146 D, 145
See application file for complete search history.

(56) References Cited

U.S. PATENT DOCUMENTS

| | | | |
|---|---|---|---|
| 32,490 | A | 6/1861 | Towers |
| 45,776 | A | 1/1865 | Watson |
| 91,547 | A | 6/1869 | Leathe |
| 105,671 | A | 7/1870 | Gunn |
| 112,439 | A | 3/1871 | Francis |
| 219,436 | A | 9/1879 | Beneke |
| 487,860 | A | 12/1892 | Vail |
| 519,656 | A | 5/1894 | Barber |
| 808,948 | A | 1/1906 | Roberts |
| 827,330 | A | 7/1906 | Tillson |

(Continued)

FOREIGN PATENT DOCUMENTS

| | | | |
|---|---|---|---|
| CN | 2138904 | Y | 7/1993 |
| CN | 2438353 | Y | 7/2001 |

(Continued)

OTHER PUBLICATIONS

Extended European Search Report received for European Patent Application No. 23159696.6, mailed on May 25, 2023, 13 pages.

(Continued)

*Primary Examiner* — Jameson D Collier
(74) *Attorney, Agent, or Firm* — Shook, Hardy & Bacon L.L.P.

(57) ABSTRACT

A footwear article includes a collar elevator that returns an ankle collar from a lowered state that is conducive to donning up to a raised state that secures the wearer's foot during wear. The collar elevator may be arranged at various positions among the footwear article, such as above or below a strobel. The collar elevator may be coupled to the footwear article using various connectors. The footwear article may have other features, such as an ankle collar, that are configured in a manner to work together with the collar elevator.

9 Claims, 11 Drawing Sheets

(56) References Cited

U.S. PATENT DOCUMENTS 841,282 A 1/1907 Tillson
863,549 A 8/1907 Metz
873,602 A 12/1907 Price
882,109 A 3/1908 Harris
905,323 A 12/1908 King et al.
907,703 A 12/1908 Peterson
911,025 A 2/1909 Blaisdell
912,579 A 2/1909 Krech et al.
1,028,598 A 6/1912 Papp
1,081,678 A 12/1913 Langerak
1,155,354 A 10/1915 Hallock
1,180,633 A 4/1916 Brackin
1,275,895 A 8/1918 Fox
1,464,342 A 8/1923 Rothacher
1,494,236 A 5/1924 Greathouse
1,515,086 A 11/1924 Baluta
1,686,175 A 10/1928 Read
1,736,110 A 11/1929 Beemer
1,972,899 A 9/1934 Odell
D98,150 S 1/1936 Drake
2,069,752 A 2/1937 Dorr
2,092,807 A 9/1937 La Chapelle
2,097,810 A 11/1937 Dawes
2,418,342 A 4/1947 Freedman
2,446,777 A 8/1948 Menenko
2,450,250 A 9/1948 Napton
2,452,502 A 10/1948 Tarbox
2,513,005 A 6/1950 Crawford
2,523,221 A 9/1950 Craven
2,619,744 A 12/1952 Mattes
2,629,942 A * 2/1953 Tucceri ..... A43B 9/06 36/22 A
2,736,110 A 2/1956 Hardimon
2,787,063 A 4/1957 Austin
2,825,155 A 3/1958 Hines
2,853,805 A 9/1958 Dratman
2,920,402 A 1/1960 Minera
2,942,359 A 6/1960 Bushway et al.
3,014,288 A 12/1961 Evans et al.
3,020,317 A 2/1962 Klager
3,040,454 A 6/1962 Topper et al.
3,097,438 A 7/1963 Evans
3,146,535 A 9/1964 Owings
3,192,651 A 7/1965 Smith
3,261,114 A 7/1966 Saunders
3,268,912 A 8/1966 Whelan
3,583,081 A 6/1971 Hideo
3,621,592 A 11/1971 Goldmerstein
3,798,802 A 3/1974 Saunders
3,810,318 A 5/1974 Epstein
4,302,892 A 12/1981 Adamik
4,366,631 A 1/1983 Larsen et al.
4,449,306 A 5/1984 Cavanagh
4,450,634 A 5/1984 Bell
4,489,509 A 12/1984 Libit
4,506,462 A 3/1985 Cavanagh
4,566,206 A 1/1986 Weber
4,608,769 A 9/1986 Sturlaugson
4,615,127 A 10/1986 Delery
4,685,223 A 8/1987 Long
4,876,053 A 10/1989 Norton et al.
4,876,806 A 10/1989 Robinson et al.
4,941,273 A 7/1990 Gross
4,972,613 A 11/1990 Loveder
5,054,216 A 10/1991 Lin
5,079,856 A 1/1992 Truelsen
5,090,140 A 2/1992 Sessa
5,117,567 A 6/1992 Berger
5,152,082 A 10/1992 Culpepper
5,181,331 A 1/1993 Berger
5,184,410 A 2/1993 Hamilton
5,259,126 A 11/1993 Rosen
5,276,983 A 1/1994 Hatfield
5,279,051 A 1/1994 Whatley
5,282,327 A 2/1994 Ogle
5,317,819 A 6/1994 Ellis
5,329,707 A 7/1994 Chaigne et al.
5,341,583 A 8/1994 Hallenbeck
5,371,957 A 12/1994 Gaudio
5,406,721 A 4/1995 Marcolin
5,467,537 A 11/1995 Aveni et al.
5,481,814 A 1/1996 Spencer
5,787,608 A 8/1998 Greenawalt
5,813,149 A 9/1998 Baker et al.
5,826,353 A 10/1998 Woznicki
5,842,292 A 12/1998 Siesel
5,875,569 A 3/1999 Dupree
5,921,004 A 7/1999 Lyden
5,926,978 A 7/1999 Smith
5,933,986 A 8/1999 Donnadieu
5,974,701 A 11/1999 Busch
6,000,148 A 12/1999 Cretinon
6,095,751 A 8/2000 Hirokawa et al.
6,115,945 A 9/2000 Ellis, III
6,180,606 B1 1/2001 Chen et al.
6,189,239 B1 2/2001 Gasparovic et al.
6,205,686 B1 3/2001 Davis
6,237,254 B1 5/2001 Rork et al.
6,290,559 B1 9/2001 Scott
6,298,582 B1 10/2001 Friton et al.
6,314,662 B1 11/2001 Ellis
6,360,454 B1 3/2002 Dachgruber et al.
6,378,230 B1 4/2002 Rotem et al.
6,497,058 B2 12/2002 Dietrich et al.
6,557,271 B1 5/2003 Weaver, III
6,578,288 B2 6/2003 Bernstein
6,594,921 B2 7/2003 Laio et al.
6,684,533 B1 2/2004 Su
6,766,539 B1 7/2004 Huber
6,810,606 B1 11/2004 Ellis, III
6,874,255 B2 4/2005 Bernstein
6,880,272 B2 4/2005 Wells
6,925,732 B1 8/2005 Clarke
6,938,361 B2 9/2005 Su
7,082,702 B2 8/2006 Cretinon
7,103,994 B2 9/2006 Johnson
7,188,438 B1 3/2007 Bowen
7,225,563 B2 6/2007 Chen et al.
7,392,603 B1 7/2008 Shepherd et al.
7,439,837 B2 10/2008 Mcdonald
7,685,747 B1 3/2010 Gasparovic et al.
7,707,742 B2 5/2010 Ellis, III
7,793,438 B1 9/2010 Busse et al.
7,823,299 B1 11/2010 Brigham
7,975,403 B2 7/2011 Mosher
8,020,317 B1 9/2011 Sokolowski
D648,512 S 11/2011 Schlageter et al.
8,056,264 B2 11/2011 Sato et al.
8,065,819 B2 11/2011 Kaufman
8,161,669 B2 4/2012 Keating
8,245,421 B2 8/2012 Baudouin et al.
8,671,590 B2 * 3/2014 Rasmussen ..... A43B 17/18 36/76 R
8,769,845 B2 7/2014 Lin
8,850,722 B2 10/2014 Baker et al.
9,192,204 B1 11/2015 Liles et al.
9,820,527 B2 11/2017 Pratt et al.
9,867,426 B2 1/2018 Conant et al.
D840,663 S 2/2019 Flanagan et al.
D845,303 S 4/2019 Laffon et al.
D854,303 S 7/2019 Flanagan et al.
D854,305 S 7/2019 Montross et al.
10,455,898 B1 10/2019 Orand et al.
10,617,174 B1 4/2020 Hopkins et al.
10,638,810 B1 5/2020 Cheney et al.
10,779,607 B1 9/2020 Chandel
10,905,192 B1 2/2021 Cheney
11,000,091 B1 5/2021 Kyle
11,191,321 B2 12/2021 Kilgore et al.
11,219,274 B2 1/2022 Orand et al.
11,344,077 B2 5/2022 Hopkins et al.
D981,500 S 3/2023 Mazur
2002/0014020 A1 2/2002 Ellis
2002/0053147 A1 5/2002 Borsoi et al.

(56) References Cited

U.S. PATENT DOCUMENTS

2002/0066213 A1 6/2002 Wells
2002/0092205 A1 7/2002 Hall et al.
2002/0112376 A1 8/2002 Tomat
2002/0144434 A1 10/2002 Farys et al.
2003/0070320 A1 4/2003 Ellis
2004/0088890 A1 5/2004 Matis et al.
2004/0111921 A1 6/2004 Lenormand
2004/0244226 A1 12/2004 Farys et al.
2005/0039348 A1 2/2005 Raluy et al.
2005/0081404 A1 4/2005 Hurd et al.
2005/0081406 A1 4/2005 Hoffer et al.
2005/0193592 A1 9/2005 Dua et al.
2005/0198869 A1 9/2005 Bouche et al.
2005/0210706 A1 9/2005 Johnson
2006/0010718 A1 1/2006 Auger et al.
2006/0032091 A1 2/2006 Kilgore
2006/0037217 A1 2/2006 Bernstein
2006/0096127 A1 5/2006 McAllister
2007/0074425 A1 4/2007 Leong
2007/0256332 A1 11/2007 Calderone
2008/0054600 A1 3/2008 Caslowitz
2008/0083138 A1 4/2008 Lacorazza et al.
2008/0086911 A1 4/2008 Labbe
2008/0120871 A1 5/2008 Sato et al.
2008/0155788 A1 7/2008 Wilcox
2008/0307673 A1 12/2008 Johnson
2009/0100712 A1 4/2009 Baker et al.
2010/0293811 A1 11/2010 Truelsen
2011/0016751 A1 1/2011 Somerville
2011/0056091 A1 3/2011 Shmurak et al.
2011/0078922 A1 4/2011 Cavaliere et al.
2011/0078924 A1 4/2011 Rackiewicz et al.
2011/0119959 A1* 5/2011 Bodner ..... A43B 15/00 36/78
2011/0146106 A1 6/2011 Kaufman
2011/0185592 A1 8/2011 Nishiwaki et al.
2011/0271556 A1 11/2011 Dillenbeck
2011/0308108 A1 12/2011 Berns et al.
2011/0308109 A1 12/2011 Sokolowski
2012/0073160 A1 3/2012 Marvin et al.
2012/0079742 A1 4/2012 Ferreira et al.
2012/0160883 A1 6/2012 Kasravi
2012/0180338 A1 7/2012 Lin
2012/0192453 A1 8/2012 Raysse et al.
2012/0198721 A1 8/2012 Cavaliere
2012/0216422 A1 8/2012 Ikezawa et al.
2012/0297643 A1* 11/2012 Shaffer ..... B32B 27/12 36/83
2012/0304491 A1 12/2012 Kimura et al.
2012/0317839 A1 12/2012 Pratt
2013/0118035 A1 5/2013 Segato et al.
2013/0185959 A1 7/2013 Coleman
2013/0219747 A1 8/2013 Lederer
2013/0247416 A1 9/2013 Nurse et al.
2014/0013617 A1 1/2014 Montross et al.
2014/0130376 A1 5/2014 Fahmi et al.
2014/0137434 A1 5/2014 Craig
2014/0150292 A1 6/2014 Podhajny et al.
2014/0173935 A1 6/2014 Sabbioni
2014/0202044 A1 7/2014 Adami et al.
2014/0223671 A1 8/2014 Fisher et al.
2014/0305005 A1 10/2014 Yeh
2015/0020416 A1 1/2015 Wiens
2015/0089835 A1 4/2015 Hammerslag et al.
2015/0143720 A1 5/2015 Avar
2015/0237960 A1 8/2015 Mallen et al.
2015/0305432 A1 10/2015 Wiens
2015/0335098 A1 11/2015 Monroy et al.
2016/0007687 A1 1/2016 Surace et al.
2016/0029743 A1 2/2016 Cavaliere et al.
2016/0081431 A1 3/2016 Ebadi
2016/0088899 A1 3/2016 Liles et al.
2016/0113356 A1 4/2016 Clough et al.
2016/0302530 A1 10/2016 Smith et al.
2016/0324269 A1 11/2016 Dombrow et al.
2016/0332063 A1 11/2016 Van Horne
2016/0345660 A1 12/2016 Chen
2016/0374427 A1 12/2016 Zahabian
2017/0020231 A1 1/2017 Hausmann et al.
2017/0030632 A1 2/2017 Kranovich
2017/0055630 A1 3/2017 Marshall
2017/0095102 A1 4/2017 Tong
2017/0099908 A1 4/2017 Lee et al.
2017/0105485 A1 4/2017 Schenone et al.
2017/0231319 A1 8/2017 Bohnsack et al.
2017/0303632 A1 10/2017 Pratt et al.
2017/0325544 A1 11/2017 Ngene
2017/0360143 A1 12/2017 Pratt et al.
2017/0360151 A1 12/2017 Pratt
2017/0370027 A1 12/2017 Da Costa Pereira Machado et al.
2018/0098601 A1 4/2018 Hartenstein et al.
2018/0110287 A1 4/2018 Hopkins et al.
2018/0110288 A1 4/2018 Hatfield et al.
2018/0110289 A1 4/2018 Owings et al.
2018/0110292 A1 4/2018 Beers et al.
2018/0116336 A1 5/2018 Dallas
2018/0146744 A1 5/2018 Guest et al.
2018/0206588 A1* 7/2018 Pratt ..... A43B 11/00
2018/0213882 A1 8/2018 Morse
2018/0235314 A1 8/2018 Farage
2018/0263332 A1 9/2018 Bruno
2018/0279721 A1 10/2018 Doenges
2018/0289109 A1 10/2018 Beers et al.
2018/0338583 A1 11/2018 Sullivan
2018/0360164 A1 12/2018 Markison et al.
2019/0045884 A1 2/2019 Uda et al.
2019/0297999 A1 10/2019 Nakaya et al.
2019/0320760 A1 10/2019 Boghossian
2020/0000178 A1 1/2020 Pratt et al.
2020/0196703 A1 6/2020 Hopkins
2020/0196709 A1 6/2020 Orand et al.
2020/0205511 A1 7/2020 Hopkins et al.
2020/0205516 A1 7/2020 Kilgore
2020/0205517 A1 7/2020 Happen
2020/0205518 A1 7/2020 Hopkins et al.
2020/0205520 A1 7/2020 Kilgore
2020/0229536 A1 7/2020 Hopkins et al.
2020/0253333 A1 8/2020 Kilgore et al.
2020/0275731 A1 9/2020 Bell et al.
2020/0297076 A1 9/2020 Kilgore
2020/0305552 A1 10/2020 Cheney et al.
2020/0390183 A1 12/2020 Arnold
2021/0068494 A1 3/2021 Zahabian
2021/0068498 A1 3/2021 Cheney et al.
2021/0106094 A1 4/2021 Cheney
2021/0112914 A1 4/2021 Cheney
2021/0112915 A1 4/2021 Hopkins
2021/0112916 A1 4/2021 Schulten
2021/0204643 A1 7/2021 Kyle
2021/0204644 A1 7/2021 Kyle
2021/0282495 A1 9/2021 Davis et al.
2021/0378356 A1 12/2021 Cheney et al.
2022/0000220 A1 1/2022 Orand et al.
2022/0273069 A1 9/2022 Hopkins et al.
2022/0361627 A1 11/2022 Cheney et al.
2022/0400816 A1 12/2022 Kilgore
2023/0012918 A1 1/2023 Hopkins et al.
2023/0015921 A1 1/2023 Hopkins et al.
2023/0016825 A1 1/2023 Hopkins et al.
2023/0030734 A1 2/2023 Farina
2023/0033366 A1 2/2023 Farina
2023/0107425 A1 4/2023 Andreasen et al.
2023/0225450 A1 7/2023 Cheney et al.
2023/0248113 A1 8/2023 Kilgore
2023/0270202 A1 8/2023 Hopkins et al.
2023/0284748 A1 9/2023 Weeks et al.
2023/0301394 A1 9/2023 Cristobal et al.
2023/0329393 A1 10/2023 Cortez et al.
2023/0380538 A1 11/2023 Cristobal
2023/0380539 A1 11/2023 Hopkins et al.
2024/0032645 A1 2/2024 Munger et al.

(56) References Cited

U.S. PATENT DOCUMENTS

| | | | |
|---|---|---|---|
| 2024/0122300 | A1 | 4/2024 | Farina |
| 2024/0138517 | A1 | 5/2024 | Obedian |

FOREIGN PATENT DOCUMENTS

| | | | |
|---|---|---|---|
| CN | 1403041 | A | 3/2003 |
| CN | 1579278 | A | 2/2005 |
| CN | 1832693 | A | 9/2006 |
| CN | 1993064 | A | 7/2007 |
| CN | 101022744 | A | 8/2007 |
| CN | 201005111 | Y | 1/2008 |
| CN | 101480282 | A | 7/2009 |
| CN | 101991227 | A | 3/2011 |
| CN | 102573545 | A | 7/2012 |
| CN | 101991227 | B | 8/2012 |
| CN | 102762121 | A | 10/2012 |
| CN | 202750821 | U | 2/2013 |
| CN | 103313622 | A | 9/2013 |
| CN | 103564977 | A | 2/2014 |
| CN | 104203024 | A | 12/2014 |
| CN | 204317632 | U | 5/2015 |
| CN | 105163616 | A | 12/2015 |
| CN | 105188453 | A | 12/2015 |
| CN | 105611851 | A | 5/2016 |
| CN | 205568021 | U | 9/2016 |
| CN | 106604656 | A | 4/2017 |
| CN | 107072349 | A | 8/2017 |
| CN | 107708468 | A | 2/2018 |
| CN | 107750132 | A | 3/2018 |
| CN | 108697196 | A | 10/2018 |
| DE | 3928625 | A1 | 3/1991 |
| DE | 19534249 | A1 | 3/1997 |
| DE | 19611797 | A1 | 10/1997 |
| DE | 29809404 | | 8/1998 |
| DE | 10247163 | A1 | 4/2004 |
| DE | 102004005288 | A1 | 8/2005 |
| EP | 0149362 | A2 | 7/1985 |
| EP | 1059044 | A1 | 12/2000 |
| EP | 2319344 | A1 | 5/2011 |
| EP | 2438826 | A1 | 4/2012 |
| EP | 3902426 | A1 | 11/2021 |
| FR | 1083503 | A | 1/1955 |
| FR | 1474203 | A | 3/1967 |
| GB | 503525 | A | 4/1939 |
| GB | 1016554 | A | 1/1966 |
| GB | 201314384 | | 9/2013 |
| GB | 2517148 | A | 2/2015 |
| GB | 2517399 | A | 2/2015 |
| JP | 50-11740 | U | 2/1975 |
| JP | 56-158803 | U | 11/1981 |
| JP | 57-72603 | A | 5/1982 |
| JP | 59-132509 | U | 9/1984 |
| JP | 1-80010 | U | 5/1989 |
| JP | 1-81910 | U | 6/1989 |
| JP | 01-181910 | A | 7/1989 |
| JP | 1-179511 | U | 12/1989 |
| JP | 11-081910 | A | 3/1999 |
| JP | 2000-139502 | A | 5/2000 |
| JP | 2000-184902 | A | 7/2000 |
| JP | 2001-149394 | A | 6/2001 |
| JP | 2005-046520 | A | 2/2005 |
| JP | 2005-532115 | A | 10/2005 |
| JP | 2006-055571 | A | 3/2006 |
| JP | 2008-132227 | A | 6/2008 |
| JP | 2012-061046 | A | 3/2012 |
| JP | 2012110687 | A | 6/2012 |
| JP | 3219334 | U | 12/2018 |
| JP | 2022-514057 | A | 2/2022 |
| KR | 10-2009-0130804 | A | 12/2009 |
| NL | 2000762 | C1 | 1/2009 |
| TW | 200743450 | A | 12/2007 |
| WO | 90/00358 | A1 | 1/1990 |
| WO | 02/13641 | A1 | 2/2002 |
| WO | 2007/080205 | A1 | 7/2007 |
| WO | 2009/154350 | A1 | 12/2009 |
| WO | 2010/059716 | A2 | 5/2010 |
| WO | 2015/183486 | A1 | 12/2015 |
| WO | 2016/002412 | A1 | 1/2016 |
| WO | 2017/090195 | A1 | 6/2017 |
| WO | 2017/184943 | A1 | 10/2017 |
| WO | 2018/081209 | A1 | 5/2018 |
| WO | 2020/139990 | A1 | 7/2020 |

OTHER PUBLICATIONS

Intention to Grant received for European Patent Application No. 19842673.6, mailed on Jun. 9, 2023, 7 pages.

Nike Lunarglide 7 Review, Solereview Inc., Available online at <https://www.solereview.com/nike-lunarglide-7-review/>, Nov. 8, 2015, 40 pages.

Non-Final Office Action received for U.S. Appl. No. 17/950,781, mailed on May 16, 2023, 5 pages.

Non-Final Office Action received for U.S. Appl. No. 17/950,857, mailed on Jun. 20, 2023, 13 pages.

Intention to Grant received for European Patent Application No. 19839789.5, mailed on Aug. 16, 2023, 7 pages.

Non-Final Office Action received for U.S. Appl. No. 17/135,220, mailed on Aug. 18, 2023, 25 pages.

Non-Final Office Action received for U.S. Appl. No. 17/895,188, mailed on Sep. 27, 2023, 10 pages.

Office Action received for European Patent Application No. 19842672.8, mailed on Sep. 27, 2023, 5 pages.

Extended European Search Report received for European Application No. 22191953.3, mailed on Jan. 9, 2023, 10 pages.

Final Office Action received for U.S. Appl. No. 17/135,220, mailed on Jan. 25, 2023, 22 pages.

Non-Final Office Action received for U.S. Appl. No. 17/950,814, mailed on Dec. 27, 2022, 10 pages.

Non-Final Office Action received for U.S. Appl. No. 17/950,781, mailed on Dec. 14, 2022, 9 Pages.

Non-Final Office Action received for U.S. Appl. No. 17/950,798, mailed on Dec. 16, 2022, 8 pages.

Notice of Allowance received for U.S. Appl. No. 17/482,809, mailed on Feb. 1, 2023, 5 pages.

Office Action received for European Patent Application No. 19842673.6, mailed on Feb. 7, 2023, 6 pages.

Notice of Allowance received for U.S. Appl. No. 17/750,193, mailed on Jul. 19, 2023, 5 pages.

Notice of Allowance received for U.S. Appl. No. 17/950,814, mailed on Aug. 2, 2023, 5 pages.

Anonymous, "Two Piece Snap Rivets", ITW Fastex, Plastic Fasteners Catalog, Retrieved from the Internet: <http://www.itw-fastex.com/catalog/index.php/dw/op/a/6/c/14/p/27?m=no#/specs>, Jan. 30, 2008, pp. 1-2.

Final Office Action received for U.S. Appl. No. 17/950,857, mailed on Nov. 9, 2023, 23 pages.

Intention to Grant received for European Patent Application No. 19839786.1, mailed on Oct. 12, 2023, 7 pages.

Non- Final Office Action received for U.S. Appl. No. 17/950,814, mailed on Apr. 6, 2023, 8 pages.

Non-Final Office Action received for U.S. Appl. No. 17/750,193, mailed on Apr. 7, 2023, 8 pages.

Notice of Allowance received for U.S. Appl. No. 16/839,744, mailed on Apr. 5, 2023, 15 pages.

Notice of Allowance received for U.S. Appl. No. 17/950,781, mailed on Mar. 29, 2023, 7 pages.

Notice of Allowance received for U.S. Appl. No. 17/950,798, mailed on Mar. 27, 2023, 7 pages.

Office Action received for European Patent Application No. 19839789.5, mailed on Mar. 9, 2023, 5 pages.

Non-Final Office Action received for U.S. Appl. No. 18/233,578, mailed on May 14, 2024, 11 pages.

Extended European Search Report received for European Application No. 23209705.5, mailed on Feb. 12, 2024, 14 pages.

Extended European Search Report received for European Patent Application No. 23215566.3, mailed on Mar. 4, 2024, 10 pages.

Non-Final Office Action received for U.S. Appl. No. 17/950,857, mailed on Mar. 13, 2024, 34 pages.

Notice of Allowance received for U.S. Appl. No. 17/895,188, mailed on Feb. 5, 2024, 8 pages.

(56) References Cited

OTHER PUBLICATIONS

Notice of Allowance received for U.S. Appl. No. 17/895,188, mailed on Feb. 15, 2024, 5 pages.
Notice of Allowance received for U.S. Appl. No. 17/895,188, mailed on Feb. 28, 2024, 3 pages.
Office Action received for European Application No. 23159696.6, mailed on Apr. 11, 2024, 8 pages.
Final Office Action received for U.S. Appl. No. 17/950,857, mailed on Sep. 9, 2024, 49 pages.
Final Office Action received for U.S. Appl. No. 18/233,578, mailed on Sep. 9, 2024, 11 pages.
Non-Final Office Action received for U.S. Appl. No. 18/381,989, mailed on Jul. 24, 2024, 8 pages.
Non-Final Office Action received for U.S. Appl. No. 18/538,762, mailed on Sep. 6, 2024, 7 pages.
Non-Final Office Action received for U.S. Appl. No. 18/539,456, mailed on Sep. 6, 2024, 16 pages.
Non-Final Office Action received for U.S. Appl. No. 18/538,780, mailed on Jan. 6, 2025, 9 pages.
Office Action received for European Application No. 23209705.5, mailed on Jan. 16, 2025, 8 pages.
Office Action received for European Application No. 23215566.3, mailed on Jan. 16, 2025, 6 pages.
Office Action received for European Application No. 23209705.5, mailed on May 9, 2025, 8 pages.
Notice of Allowance received for U.S. Appl. No. 18/381,989, mailed on Oct. 24, 2024, 7 pages.
Office Action received for European Application No. 23159696.6, mailed on Dec. 3, 2024, 7 pages.
Final Office Action received for U.S. Appl. No. 18/538,762, mailed on Jan. 31, 2025, 7 pages.
Final Office Action received for U.S. Appl. No. 18/538,780, mailed on Apr. 11, 2025, 13 pages.
Final Office Action received for U.S. Appl. No. 18/539,456, mailed on Mar. 4, 2025, 17 pages.
Non-Final Office Action received for U.S. Appl. No. 17/950,857, mailed on Apr. 24, 2025, 30 pages.
Non-Final Office Action received for U.S. Appl. No. 18/538,762, mailed on Mar. 31, 2025, 8 pages.
Non-Final Office Action received for U.S. Appl. No. 18/538,780 , mailed on Jul. 17, 2025, 9 pages.
Notice of Allowance received for U.S. Appl. No. 18/538,762, mailed on Jul. 24, 2025, 5 pages.

* cited by examiner

FOOTWEAR ARTICLE WITH COLLAR ELEVATOR

CROSS REFERENCE TO RELATED APPLICATION

This application is a divisional application of U.S. application Ser. No. 16/725,754 (filed Dec. 23, 2019), which claims priority to, and the benefit of, U.S. Provisional Application No. 62/785,969 (filed Dec. 28, 2018). Each of the aforementioned applications is hereby incorporated herein by reference in its entirety.

TECHNICAL FIELD

This disclosure relates to a footwear article having a collar elevator.

BACKGROUND

Some footwear articles include an ankle collar that is manipulated when the footwear article is put on. For example, the ankle collar may be depressed towards the sole as the wearer's foot is slid into the upper. Furthermore, some of these footwear articles include a collar elevator operable to move the ankle collar from the depressed or lowered state to the raised state. An example of one type of collar elevator is described in U.S. Pat. No. 9,820,527, and examples of other collar elevators are described in US Pat. Pub. 2018/0110292 and US Pat. Pub. 2018/0289109.

BRIEF DESCRIPTION OF THE DRAWINGS

Some subject matter described in this disclosure makes reference to drawing figures, which are incorporated herein by reference in their entirety.

DETAILED DESCRIPTION

Figure 1:
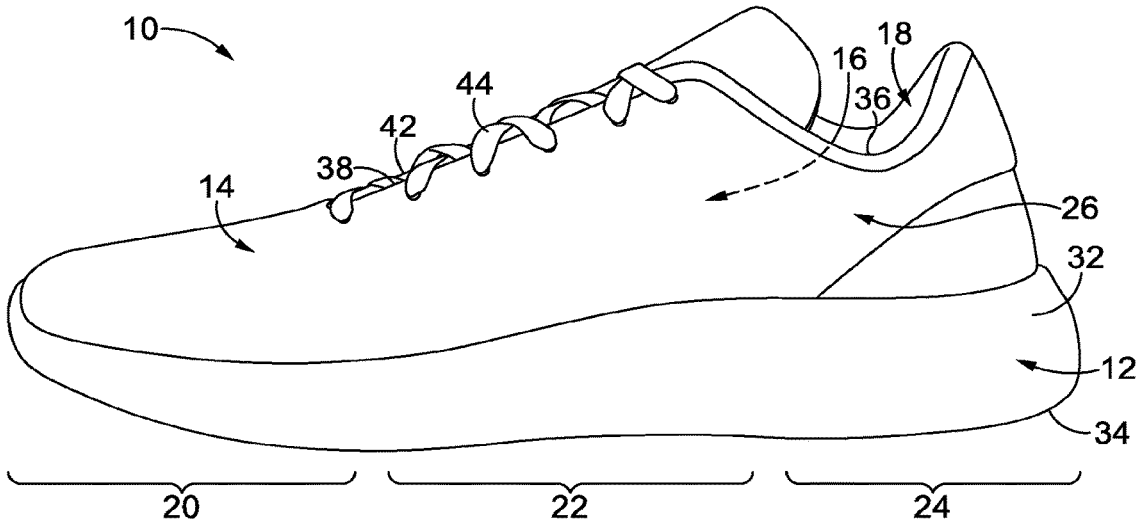
FIG. 1 depicts a side view of a footwear article in accordance with an aspect of this disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear article that may be slipped on with minimal to no adjustments needed by one's hands, including manufactures and methods associated therewith. In some aspects, the footwear article may include a collar elevator that moves an ankle collar from a lowered state to a raised state.

Before describing the figures in more detail, some additional explanation will now be provided related to certain terminology that may be used in this disclosure.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the invention, as defined by the claims.

The term "longitudinal," as possibly used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

Figure 2:
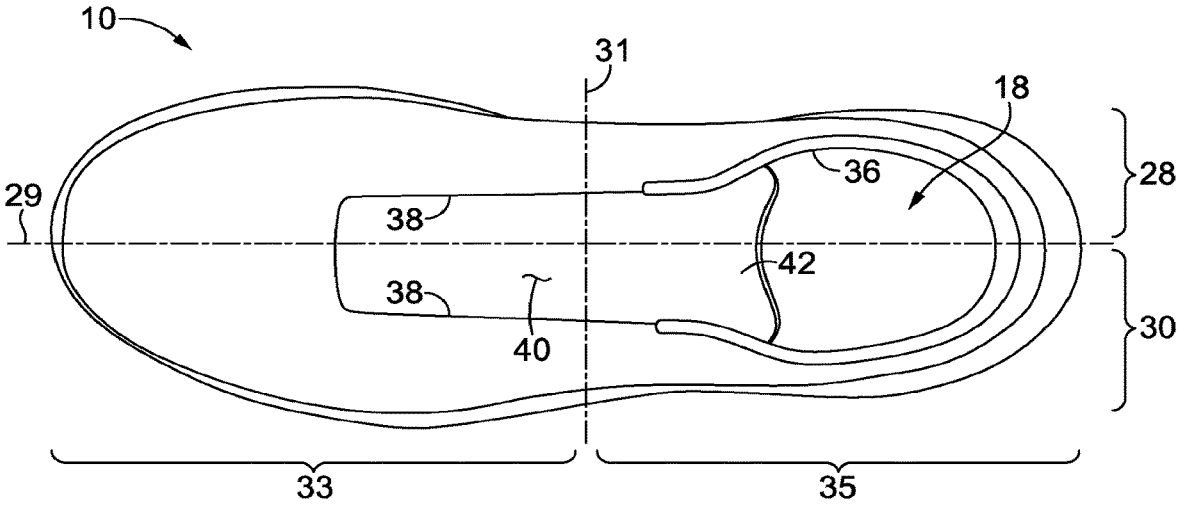
FIG. 2 depicts a top view of the footwear article of FIG. 1 in accordance with an aspect of this disclosure.

In order to aid in the explanation of, and understanding of, aspects of this Specification, reference is now made to FIGS. 1 and 2 to describe elements of a typical footwear article 10, which may include a tongue reinforcer. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the footwear article 10 corresponding with the toes and the joints connecting the metatarsals with the phalanges. The midfoot region 22 generally includes portions of the footwear article 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the footwear article 10, each falling on an opposite side of a longitudinal midline reference plane 29 of the footwear article 10, as is understood by those skilled in the art. For example, the longitudinal midline reference plane 29 may pass through the foremost point of the sole structure and the rearmost point of the sole structure. The medial side 29 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the footwear article 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylene vinyl acetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot. The tongue 42 may include a discrete component that is affixed at one or more locations to the upper, or alternatively, the tongue may be an integrally formed region of the upper. Additional aspects contemplate the elongated opening 40 (which may also be referred to as a forefoot opening) may be omitted and instead the medial and lateral sides of the upper converge and are continuous across an area that traditionally includes the elongated opening 40.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Figure 3A:
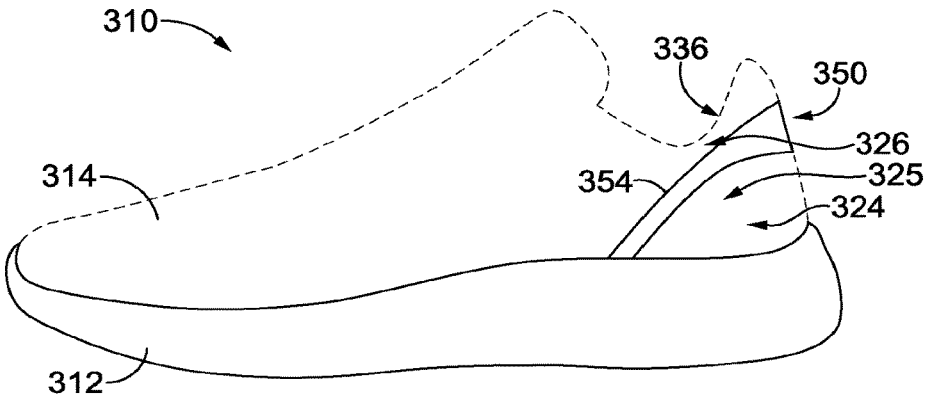
FIGS. 3A-3C depict another footwear article having a collar elevator in accordance with an aspect of this disclosure.
Figure 3B:
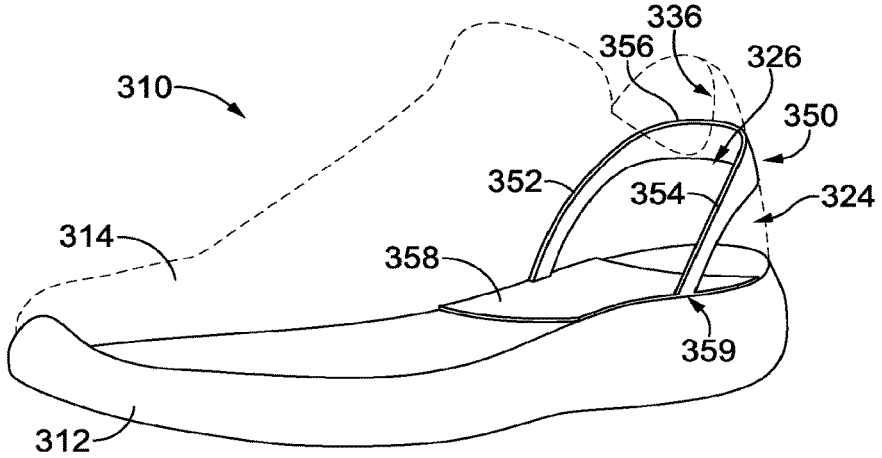
Figure 3C:
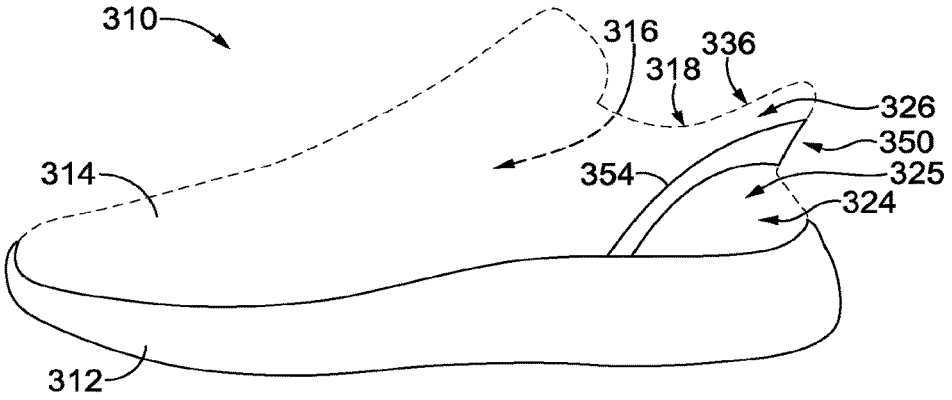

Having described FIGS. 1 and 2, reference is now made to FIGS. 3A-3C and 4A-4C to describe some other aspects of this disclosure. Each of FIGS. 3A, 3B, and 3C depicts a footwear article 310, which includes an upper 314 coupled to a sole 312, and the upper 314 includes a heel region 324 and an ankle region 326 with an ankle collar 336. The ankle collar 336 is movable between a lowered state (as depicted in FIG. 3C) and a raised state (as depicted in FIGS. 3A and 3B). In the lowered state, the ankle collar 336 is positioned closer to the sole 312, and in the raised state, the ankle collar 336 is positioned farther from the sole 312. Similarly, the footwear article 410 includes an upper 414 coupled to a sole 412, and the upper 414 includes a heel region 424 and an ankle region 426 with an ankle collar 436.

Figure 4A:
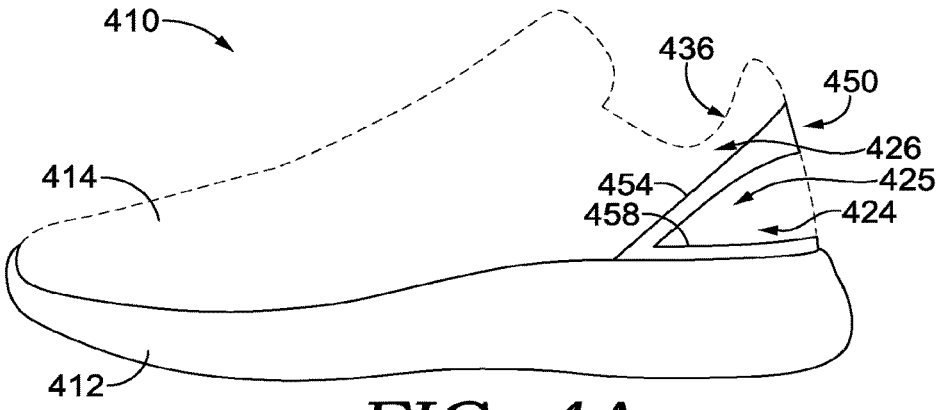
FIGS. 4A-4C depict another footwear article having an alternative collar elevator in accordance with an aspect of this disclosure.
Figure 4B:
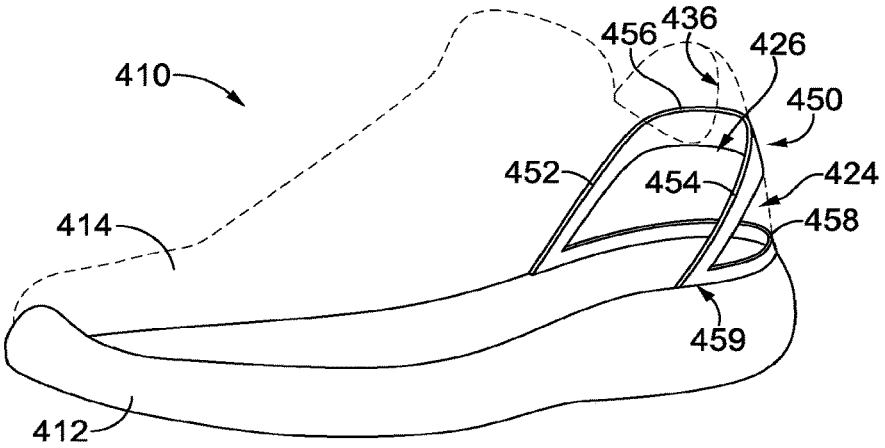
Figure 4C:
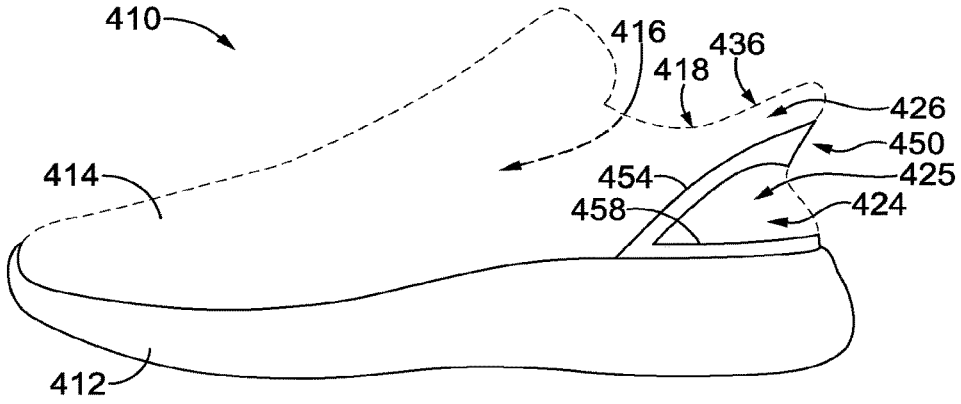

Furthermore, the footwear article 310 includes a collar elevator 350 that is coupled to the upper 314 near the heel region 324 and/or the ankle region 326 and that is operable to move the ankle collar 336 from the lowered state to the raised state. More specifically, the collar elevator 350 includes portions that are positioned in the heel region 324 and that extend up into the ankle region 326. As previously indicated, there are not necessarily precise delineations between the heel region 324 and the ankle region 326; rather, describing the positioning of the collar elevator 350 with respect to these regions is one way to describe that the collar elevator 350 extends from a more inferior part closer to the sole to a more superior part closer to the ankle collar 336. As far as the coupling of the collar elevator 350 to the upper 314 near the heel region 324 and/or near the ankle region 326, this coupling may take various forms. For example, the collar elevator 350 may be coupled to the upper in the heel region 324, in the ankle region 326, to the ankle collar 336, or any and all combinations thereof. The collar elevator 350 is an example of one type of collar elevator operable to move an ankle collar from the lowered state to the raised state, and as will be described in other portions of this disclosure, a collar elevator may include one or more alternative structures than those depicted in FIGS. 3A-3C. For example, FIGS. 4A-4C depict a footwear article 410 with a collar elevator 450 that is operable to move the ankle collar 436 from the lowered state (e.g., FIG. 4C) to the raised state (e.g., FIGS. 4A and 4B) and that has a different structure from the collar elevator 350.

For illustrative purposes, the upper 314 and the upper 414 is ghosted in dashed lines, and a collar elevator may be arranged in various locations with respect to an upper. For example, a collar elevator may be affixed at least partially, and possibly entirely, between an exterior layer and an inner lining in the heel region, in the ankle region, in the ankle collar, or any and all combinations thereof. In another aspect, a collar elevator may be at least partially exposed and arranged on the outside or exterior surface of the upper. In a further aspect, at least a portion of the collar elevator may be arranged on the inside, foot-facing surface of an inner lining. In another aspect, the collar elevator might be arranged on the exterior of the footwear article and might be attached to a heel portion of the ankle collar by a tab, heat stake, bonding agent, stitch, or other coupling.

A collar elevator (such as the collar elevators 350 and 450) may include various elements. In one aspect, a collar elevator includes a medial lever arm, a lateral lever arm, and a center connecting band that couples the medial lever arm to the lateral lever arm and that is located in a heel portion of the ankle collar. In a further aspect, each lever arm is affixed to a base, which remains stationary relative to the lever arms as the lever arms deform when the ankle collar is moved to a lowered state. The base may be a portion of the footwear article, such as a portion of the sole or a portion of the upper. In addition, the base may be one or more other anchors affixed directly or indirectly to the sole, the sole itself, or any combination thereof. U.S. Pat. No. 9,820,527 describes one or more collar elevators, some of which may be referred to as a deformable member or as deformable members (with or without a base), and the full disclosure of U.S. Pat. No. 9,820,527 is incorporated herein by reference in its entirety. In accordance with an aspect of this disclosure, at least some of the deformable members described in U.S. Pat. No. 9,820,527 include a medial lever arm, a lateral lever arm, and a center connecting band that couples the medial lever arm to the lateral lever arm. In other examples, US 2018/0110292 and US 2018/0289109 each describes a plurality of other collar elevators, some of which are referred to as a control bar (with or without a base), and the full disclosures of US 2018/0110292 and US 2018/0289109 are incorporated herein by reference in their entirety. In accordance with an aspect of this disclosure, at least some of the control bars described in US 2018/0110292 and US 2018/0289109 include a medial lever arm, a lateral lever arm, and a center connecting band that couples the medial lever arm to the lateral lever arm.

Each of the illustrated collar elevators 350 and 450 depicts examples of medial lever arms 352 and 452, respectively. In addition, each of the illustrated collar elevators 350 and 450 depicts examples of lateral lever arms 354 and 454, respectively, and center connecting bands 356 and 456, respectively. Furthermore, the lever arms 352 and 354 attach to a base 358, and the lever arms 452 and 454 attach to a base 458 having a different structure from the base 358. The base 358 is affixed to or near a foot-facing surface of the sole 312, and the base 358 might be a portion of an outsole, a portion of a midsole, a portion of an insole, a portion of a strobel, a plate or sheet of material layered between any of these sole layers, or any combination thereof. Among other things, the base 358 might include a rigid portion or section to which the lever arms 352 and 354 are anchored. FIGS. 4A-4C depict a different aspect, in which the base 458 might attach to a portion of the upper (e.g., a heel counter), a portion of the midsole sidewall, or any combination thereof, and the base 458 wraps around a backside of the footwear article, as opposed to extending through the footbed in the manner described with respect to the base 358.

The medial lever arm, the lateral lever arm, and the center connecting band may be a single continuous body, such that clear demarcation may not exist between the medial lever arm, the lateral lever arm, and the center connecting band. For example, the medial and lateral arms and the center connecting band may be molded, cast, 3D printed, or otherwise formed as a single, integrally formed unit. In other aspects, the medial lever arm and the lateral lever arm may be discrete, separate, and distinct elongated members, which are connected to the center connecting band, such as by a mechanical or chemical coupling, a friction fit, sheathing, or other coupling.

Having generally described some of the structural elements of a collar elevator, some operational aspects of a collar elevator will now be described. As briefly described above, the collar elevator moves the ankle collar from the lowered state to the raised state. More specifically, at least a portion of the medial lever arm, the lateral lever arm, the center connecting band, or any combination thereof, is affixed to a portion of the upper. In one aspect, the center connecting band may be affixed near a heel portion of the ankle collar. For example, as described in other portions of this disclosure, the center connecting band may be attached to the heel portion of the ankle collar by an adhesive, connection tab, heat stake, stitch, and the like. As such, when the ankle collar is moved to a lowered state closer to the sole, the medial lever arm and the lateral lever arm deform to a more compressed or more loaded position. Stated differently, the collar elevator stores potential energy by elastically deforming from a less compressed configuration (e.g., FIGS. 3A and 4A) to a more compressed configuration (e.g., FIGS. 3C and 4C) when an applied force moves the ankle collar from the raised state to the lowered state. The potential energy returns the collar elevator to the less compressed configuration upon removal of the applied force, and since the collar elevator is affixed to the upper, the ankle collar is also moved from the lowered state to the raised state. While the compression of the collar elevator may be greater when the ankle collar is moved to the lowered state (as compared with the raised state), in the raised state the collar elevator may still store potential energy in an at least partially deformed state (i.e., preloaded compression) so as to be able to hold a rear, heel portion of the ankle collar about the heel of the wearer. For example, if the collar elevator is attached to the upper heel region and/or the upper ankle region, then portions of the upper may hold or retain the collar elevator in the preloaded configuration when the ankle collar is in the raised state. In other aspects, the collar elevator may be unloaded when the ankle collar is in the raised state.

In one aspect, the portion 325 or 425 of the upper below the center connecting band may include one or more textiles that are more flexible than other portions of the upper. This more flexible region of the upper may, for example, be at least partially in the heel-counter region. Among other things, this more flexible portion 325 or 425 of the upper may collapse more easily when the ankle collar is moved to a lower state and may provide less resistance for the collar elevator (as compared with a less flexible upper in other parts of the footwear article or in a typical footwear article) when the collar elevator is returning to the less compressed state.

In some aspects, the combination of the medial lever arm, the lateral lever arm, and the center connecting band may be referred to as a deformable element. The term "deformable element" refers to a resiliently flexible member that can be bent or compressed but has a bias to move towards a non-bent or uncompressed state. The deformable element may include a single, integrally formed, deformable element, extending continuously from the medial lever arm to the lateral lever arm. In other aspects, the medial lever arm and the lateral lever arm may be two or more separate and distinct deformable elements that connect to the center connecting band, which may also be referred to as a heel piece.

In some aspects, the deformable element might be directly coupled, mounted, or attached to the base. In other aspects, the base may include one or more anchors that engage and retain the deformable element in place. For example, anchors may be located at a junction (e.g., 359 and 459) between the lever arms and the base. Such anchors might be integrally formed with, coupled to and/or located within or between or outside of portions of the sole (e.g., insole, midsole, outsole). For example, an anchor may be disposed in a block, plate, or wedge layered or embedded among, on top, or beneath the sole. In some instances, a portion of the sole (e.g., midsole) might be carved or cut out to attach to or house an anchor. In another aspect, a base extending in the mediolateral orientation (e.g., base 358) includes an anchor-shaped receptacle into which an anchor engages by way of a resistance fit, compression fit, a snap fit, or via an interlocking mechanism/configuration. In other examples, the anchors may be integrally formed with, coupled to, and/or located within, between, or outside of portions of the upper. For example, anchors may be located in the upper, in a heel counter, or any combination thereof. A single anchor may extend a full width of the footwear article, or two anchors may be positioned on opposing sides of the footwear article (e.g., on the medial and lateral sides). The deformable member may attach to the base or to an anchor at an angle. For example, the deformable member might attach at a perpendicular angle to the base and then curve or arc rearwardly. In another aspect, the deformable member might attach at a forwardly inclining angle (i.e., upwards and forwards) or a rearwardly reclining angle (i.e., upwards and rearwards) before rearwardly arcing.

A connection between the deformable member and the base or the anchors may be described in various manners. For example, in one aspect, the deformable element does not pivot (i.e., is non-pivoting) about the base (e.g., about an insole, midsole, or outsole). Described differently, the deformable element may be non-rotatably coupled to the base. In various aspects, engagement between the deformable element and the base (or anchor) is free of play, meaning that there is little or no relative movement between the two components.

A deformable element may include one or more of a tube, a wire, a spring, a shape memory structure or material, and the like. Furthermore, a deformable element can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, TPC-ET, silicone, TPU, and polycarbonate. For example, a deformable element might include titanium or be a titanium wire. Also, one or more deformable elements might be made of a first material, e.g., titanium, and one or more additional deformable elements might be made of a second material, e.g., graphite.

In some aspects, the deformable element might include a single, unitary piece. For instance, a first end of the deformable element (e.g., an end of the medial lever arm) might be embedded in, or attached to, a medial anchor; a second end of the deformable element (e.g., an end of the lateral lever arm) might be embedded in or attached to a lateral anchor; and a middle portion of the deformable element (e.g., the center connecting band) might extend around the heel portion or ankle portion of the upper, or be embedded within some additional heel-piece structure.

In other aspects, the deformable element might include a plurality of separate and distinct components. For instance, a deformable element might include two separate components, with a first component (e.g., medial lever arm) having a first end embedded in or attached to a medial anchor and a second end embedded in or attached to the medial side of a heel piece or center connecting band. As such, a second component (e.g., lateral lever arm) might similarly include a first end embedded in or attached to a lateral anchor and a second end embedded in or attached to the lateral side of the heel piece or center connecting band. The plurality of separate and distinct components can be secured together, for example, with one or more of a tape wrap, woven encasing, overmold (e.g., TPU), heat shrink tube, and the like, each of which can provide different stabilities and strengths. For example, a deformable element might include one or more wires encased independently or encased together in a cover, sleeve, overmold, or heat shrink tube. The one or more wires can arch, bend, and sway and then return to an initial/normal state in order to help facilitate the elastic deformation of the deformable element.

A deformable element might have variable mechanical properties along its length and/or at distinct points along its length. Such variation might be provided by the deformable element (e.g., by a wire or bundle of two or more wires), by a securement surrounding all or a portion of the deformable element(s), or any combination thereof. For example, the deformable element and/or the securement might have a variable cross-section, a variable density, a variable material, and/or the like along its length. A variable cross-section, in turn, can be provided by variation in thickness or shape, or twisting of the deformable element otherwise having a constant thickness or shape along its length.

As briefly described above, a deformable element may include a cover, sleeve, overmold, or other suitable structure, which might protect other elements (e.g., wire, spring, etc.) of the deformable element and might control, guide, support and/or otherwise affect the flexure or compression of the deformable element. In some aspects, the cover, based on its material of manufacture, shape, geometry, etc., is configured to facilitate mechanical stress distribution by transferring mechanical bending/deforming forces from the deformable element (e.g., from the wire(s) or spring) to the cover to prevent, or at least inhibit, the deformable element from damage or breakage that may otherwise result from the concentrated and repeated mechanical stress experienced by the deformable element. For example, the cover may have dimensions that vary along its length, such as a funnel-like tapering shape, to help distribute stress and contribute to the dynamic flexing of the deformable element. In the event that the deformable element breaks, the cover might still provide at least some degree of bias, thereby still helping to move the ankle collar from the lowered position to the raised position. Further, the cover may provide additional padding and/or support to the deformable element and may prevent, or at least inhibit, a wearer from feeling the deformable element.

As briefly described above, the center connecting band may also be referred to as a heel piece. The center connecting band may be integrally formed with the medial and lateral lever arms, as a single, continuous unit. In other aspects, the center connecting band may be a separate piece that extends between, and bridges, the medial and lateral lever arms. Among other things, the center connecting band may provide a coupling to the upper and may provide a frame to the ankle collar, to inhibit the ankle collar from collapsing into the foot-receiving opening when a foot is being inserted.

When being put on by a wearer, a footwear article with a collar elevator (e.g., collar elevators 350 and 450) might be slipped on by the wearer without the wearer using his or her hands to manipulate the footwear article. For example, the wearer's toes may be inserted through the foot-insertion openings 318 or 418, while the arch or heel of his or her foot is used to press downward on the ankle collars 336 or 436 towards the soles 312 or 412. This adjustment of the ankle collar 336 or 436 into the lowered state closer to the sole may increase a size of the foot-insertion opening 318 or 418. Once the wearer's foot has been slid into the foot-receiving cavity 316 or 416, the collar elevator 350 or 450 moves the ankle collar from the lowered state (i.e., FIGS. 3C and 4C) to the raised state (i.e., FIGS. 3A and 4A) to help secure the footwear article to the wearer's foot.

Among other things, the collar elevators 350 and 450 may reduce potential structural breakdown of the upper heel region and upper ankle region over time, which could result from repeated hands-free donning, by providing a frame operational to return to, or bias in, the raised state. Furthermore, the collar elevators 350 and 450 may allow the user to more easily don (i.e., put on) his or her shoes without the use of hands and/or without having to bend down to tie the laces, without having to use a shoe horn, or without using other such adjustment features, elements, or mechanisms for fit. Moreover, the footwear articles 310 and 410 may more easily receive, or more easily direct a wearer's foot into, or otherwise accommodate, a wearer's foot with respect to, the foot-receiving opening. This potentially easier donning may result from, among other things, the collar elevators 350 and 450 helping to provide a larger foot-insertion opening without allowing a topline of the ankle collar to fold inward towards the foot-receiving cavity.

Operation of the footwear articles 310 and 410 may be described in various manners. For example, the ankle collars 336 and 436 may be elastic or may include a goring element that permits expansion of the foot-insertion openings 318 and 418, such as when the ankle collar is moved to a lowered state. In the lowered state, the foot-insertion openings 318 and 418 may be expanded by at least about 5%, or at least about 10%, or at least about 15%. This measured expansion may be detected in various manners. For example, a first circumference of the foot-insertion opening may be measured when the ankle collar is in a first state, and a second circumference may be measured when the ankle collar is in a second state, which is closer to the sole (relative to the first state). The distance of the ankle collar from the sole in the first and second states may be measured in a vertical plane (i.e., perpendicular relative to the horizontal reference plane, including a flat ground surface on which the ground-contacting surface sits in an at-rest position), and the distance may be measured from a rearmost point of the ankle collar topline edge to a topline edge of the sole (e.g., where the sole connects to the upper at the biteline). As such, the distance in the first state will be longer than the distance in the second state, and in one aspect, the second distance is equal to or shorter than 75% of the first distance. Continuing with the above example, in the second state having the distance equal to or shorter than 75% of the distance in the first state, the circumference may be expanded by at least about 5%, or at least about 10%, or at least about 15%. In a further example, a circumference of the foot-insertion openings 318 and 418 may be expandable by at least about 1.0 inch (about 2.54 centimeters), when the ankle collar is in the second state having the distance equal to or shorter than 75% of the distance in the first state. An amount of the expansion of the foot-insertion opening 318 and 418 may vary with the shoe style and size. In other aspects, a height of the ankle collars 336 and 436 above the soles 312 and 412 in the lowered state is about 50% lower than the height in the raised state, however, as with other parameters, this may vary depending on the shoe style and size.

As described in other portions of this disclosure, the collar elevators 350 and 450 provide a return force when moving the ankle collars 336 and 436 from the lowered state to the raised state. In some aspects, the return force is between about 1 pound-force and about 15 pound-force, and this may be measured at various positions of the ankle collar. For example, as explained above, the ankle collar may include a first state having a first distance from the sole and a second state having a second distance from the sole, which is shorter than the distance in the first state. In one aspect, the collar elevators 350 and 450 provide the return force between about 1 pound-force and about 15 pound-force in the second state having the distance equal to or shorter than about 85% of the distance in the first state. In a further aspect, the collar elevators 350 and 450 provide the return force between about 1 pound-force and about 15 pound-force in the second state having the distance equal to or shorter than about 75% of the distance in the first state. Further still, the collar elevators 350 and 450 might provide the return force between about 1 pound-force and about 15 pound-force in the second state having the distance equal to or shorter than about 50% of the distance in the first state. The return force may be strong enough such that the rear of the ankle collar rebounds back up from the second state and snugly fits around the wearer's heel. For example, the ankle collars 336 and 436 may be elevated from the lowered state to the raised state in less than about 1 second, when the distance between the ankle collar and the sole in the lowered state is shorter than 85%, or shorter than 75%, or shorter than 50% of the distance in the raised state. In other aspects, ankle collars 336 and 436 may be elevated from the lowered state to the raised state in less than about 0.5 seconds, when the distance between the ankle collar and the sole in the lowered state is shorter than 85%, or shorter than 75%, or shorter than 50% of the distance in the raised state. And in further aspects, the ankle collars 336 and 436 may be elevated from the lowered state to the raised state in less than about 0.2 seconds, when the distance between the ankle collar and the sole in the lowered state is shorter than 85%, or shorter than 75%, or shorter than 50% of the distance in the raised state. This rebound time is measured absent any counteracting external forces, such as friction that might be imparted by the wearer's heel.

Figure 5A:
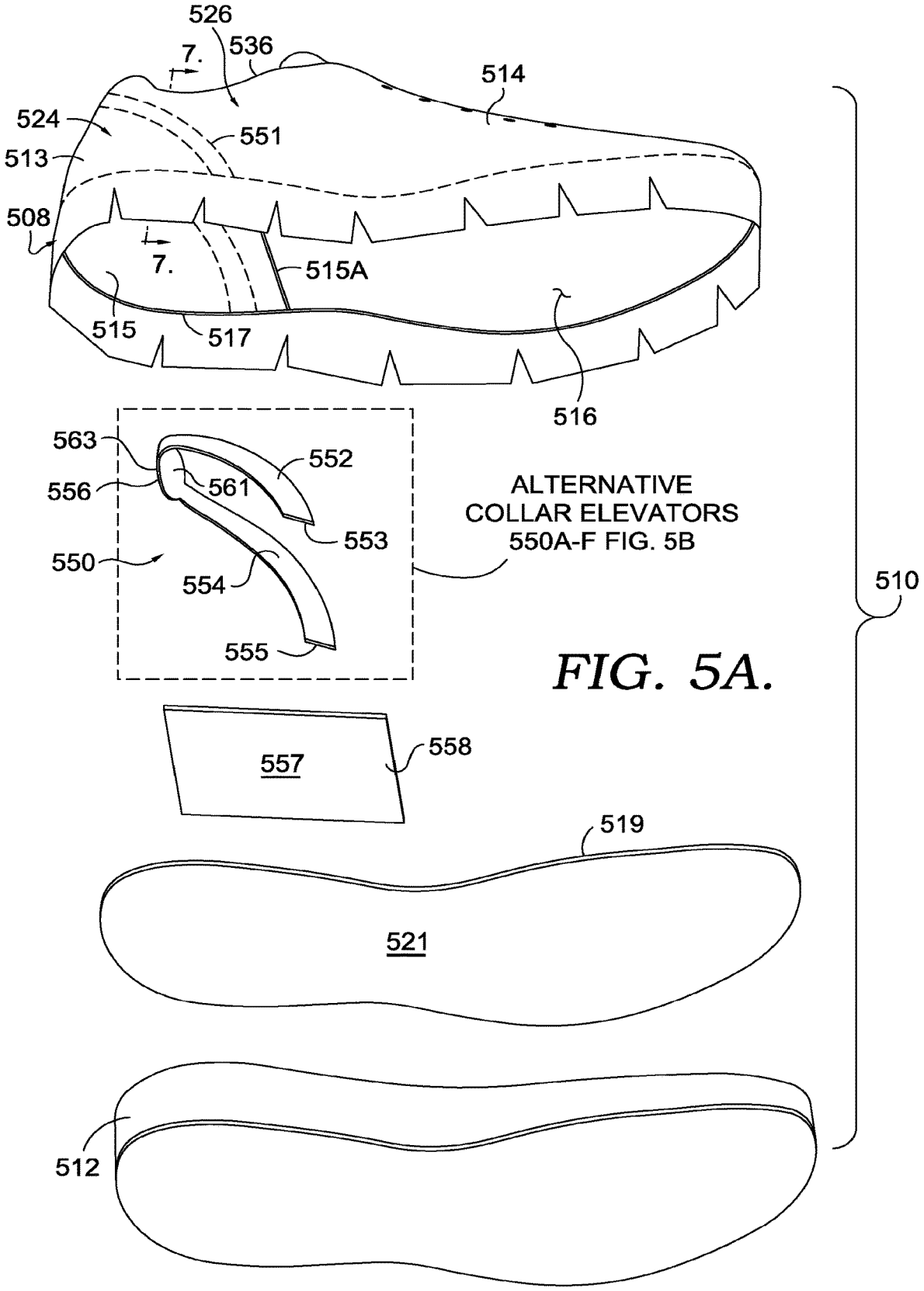
FIG. 5A depicts a footwear article that is at least partially deconstructed in accordance with an aspect of this disclosure.
Figure 6A:
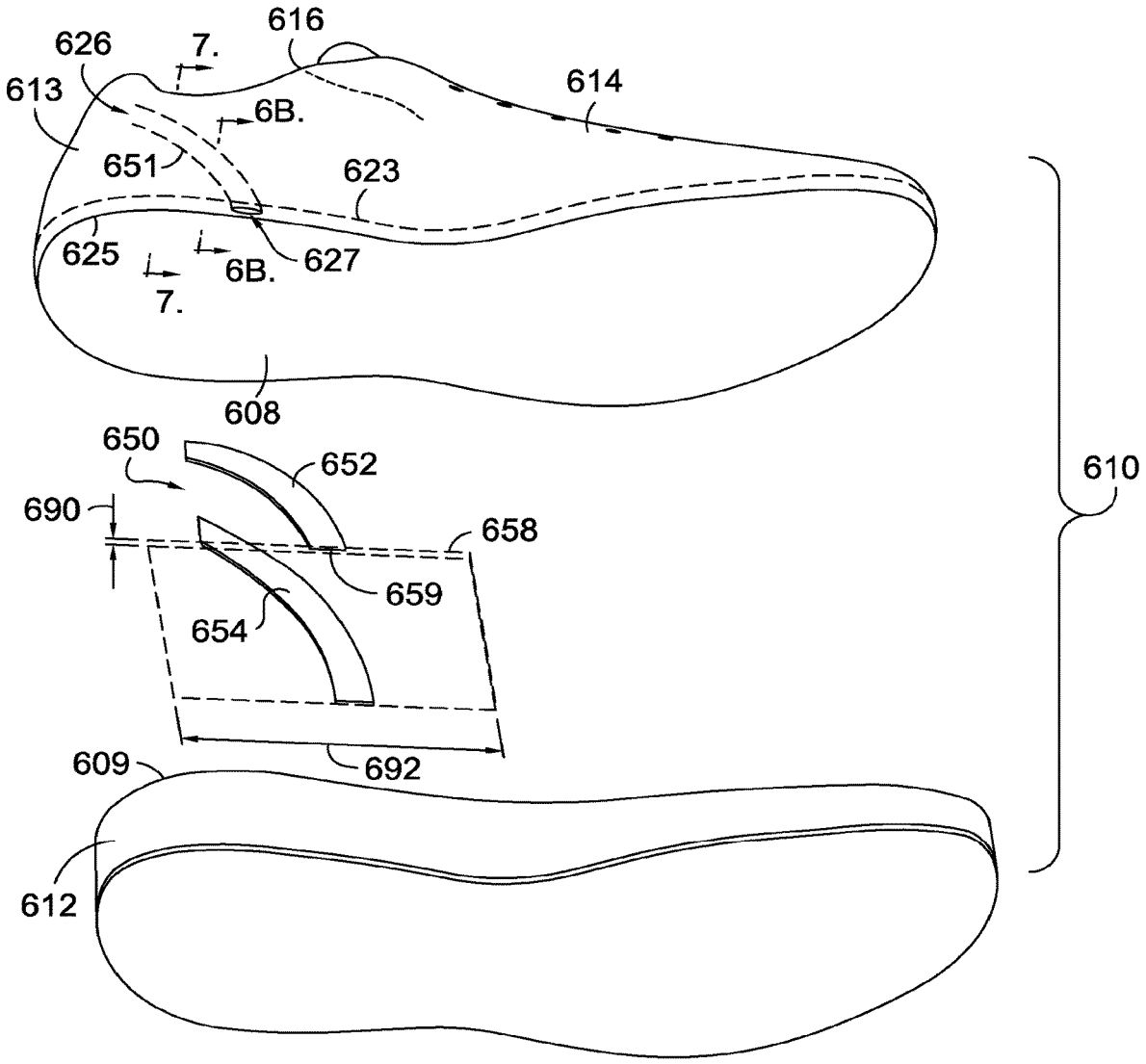
FIG. 6A depicts another footwear article that is at least partially deconstructed in accordance with an aspect of this disclosure.

The footwear articles 310 and 410 may be constructed in various manners, and referring to FIGS. 5A and 6A, illustrations are provided showing footwear articles 510 and 610 (respectively) partially deconstructed. For example, in FIG. 5A, an upper 514, a collar elevator 550, a base 558, a sole insert 519, and a sole 512 are depicted in a decoupled state; and in FIG. 6A, an upper 614, a collar elevator 650 and base 658, and a sole 612 are depicted in a decoupled state. The footwear articles 510 and 610 are similar to the footwear article 310 in that the base 558 and 658 is positioned underneath the foot-receiving cavity when the footwear article 510 is constructed. That is, the base 558 and 658 is positioned between the sole 512 and 612 and the foot-receiving cavity 516 and 616, such that when the footwear article 510 and 610 is in an as-worn configuration, the base 558 and 658 is positioned beneath the foot. While the footwear articles 510 and 610 are similar in that that bases 558 and 658 are positioned between the sole and the foot-receiving cavity (e.g., under foot), they also include various differences from one another and help to illustrate variations that might be included in the footwear article 310.

The footwear article 510 includes an upper 514 with a heel region 524 and an ankle region 526. In addition, the footwear article 510 includes an ankle collar 536 that is movable between a between a lowered state positioned closer to the sole and a raised state positioned farther from the sole. The upper also includes an outer material layer 513 and an inner material layer 515. Relative to one another, the inner material layer 515 is closer to the foot-receiving cavity 516 and the outer material layer 513 is farther from the foot-receiving cavity 516.

Figure 7A:
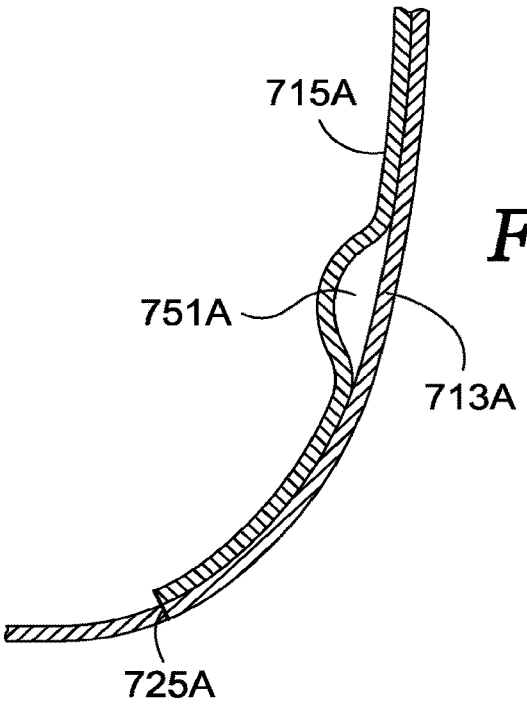
FIGS. 7A-7C depict alternative outer and inner material layers for an upper in accordance with an aspect of this disclosure.
Figure 7B:
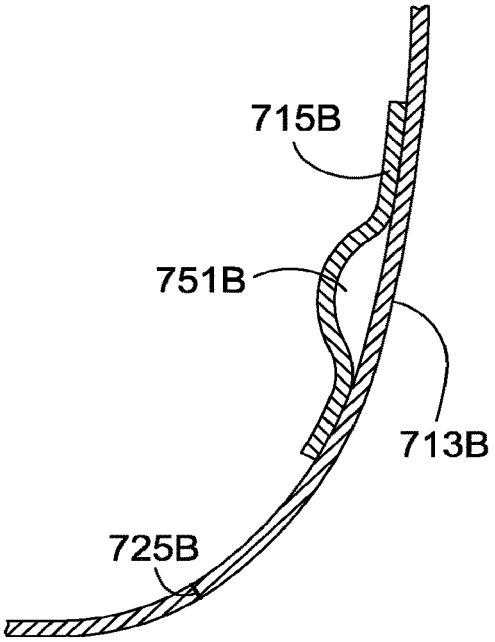
Figure 7C:
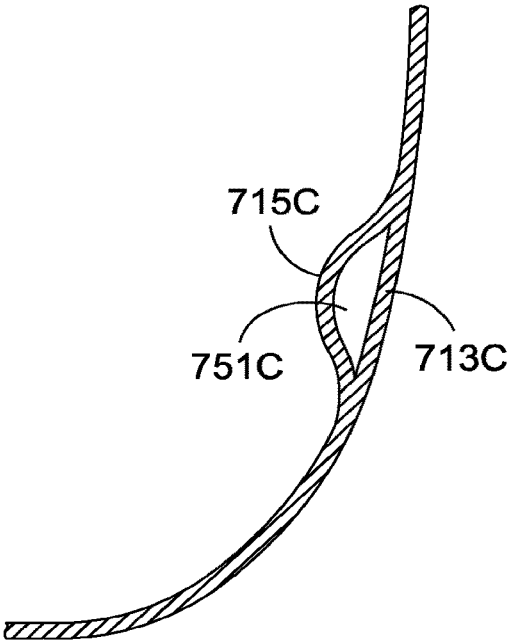

The footwear article 510 also includes a collar elevator 550, at least a portion of which is positioned between the outer material layer 513 and the inner material layer 515 when the footwear article is constructed. The dashed lines 551 are provided merely as a general guide for approximate positioning of the collar elevator 550. The inner material layer 515 is illustrated as lining the heel region 524 at least from the front edge 515A extending rearward, and FIGS. 7A-7C depict alternative variations of an outer material layer 713A-C and an inner material layer 715A-C, based on a cross-sectional view taken at reference line 7-7 in FIG. 5A. For example, FIG. 7A illustrates one aspect in which an inner material layer 715A extends from the topline edge of the ankle collar to near a strobel stitch. In other aspects depicted by FIG. 7B, the inner material layer 715B might include a smaller material panel that lines only a portion of the heel region 524. For example, the inner material layer 715B may only extend along a region aligned with the collar elevator 550, and in this respect, the inner material layer 715B may form (together with the outer material layer 713B) part of an encasement, textile sheath, or channel for the lever arms 552 and 554. Alternatively, the outer material layer might include a smaller panel (relative to the inner material layer) that overlies only a portion of the inner material layer and that extends along a region aligned with the collar elevator 550 to form an outer wall of an encasement, textile sheath, or channel for the lever arms 552 and 554. In another aspect depicted by FIG. 7C, the outer material layer 713C and the inner material layer 715C may be integrally knit with one another to form a lever-arm channel.

Furthermore, the footwear article 510 includes the base 558, which is depicted detached from the collar elevator 550 for illustrative purposes. In one aspect, the collar elevator 550 may be initially formed separately from the base 558, and then attached to the base 558 at the lever-arm terminal ends 553 and 555, such as with anchors. In another aspect, the base 558 and the collar elevator 550 might be integrally formed with one another (e.g., the base 558 is continuous with the lever arms), such as with a co-molding process.

The collar elevator 550 may be coupled between the outer and inner material layers 513 and 515 in various manners. For example, in one aspect the inner material layer 515 includes a bottom edge 517 that is detached in at least some locations from the outer material layer 513. As such, the collar elevator 550 may be placed into position by separating the bottom edge 517 from the outer material layer 513 and inserting the collar elevator 550 into the space between the inner and outer material layers 515 and 513. The base 558 might be affixed to the collar elevator 550 prior to insertion of the collar elevator 550 between the layers 513 and 515, or the base 558 might be attached during a subsequent process, such as prior to or during the lasting process. In other aspects of this disclosure, other portions of the inner material layer 515 might be left detached from the outer material layer 513 to permit placement of the collar elevator 550 therebetween. At least some of these detached portions may then be coupled to the outer material layer 513, such as by stitching or adhesive, after placement of the collar elevator 550.

After the collar elevator 550 has been positioned between the inner and outer material layers 513 and 515, the collar elevator 550 might be coupled to the upper 514 in various manners. Although adhesive or bonding agents are one option, they also have some drawbacks. For example, where the collar elevator 550 is free floating between the layers 513 and 515 prior to coupling, the bonding process may be less exact and result in inconsistent positioning from one footwear article to the next. Furthermore, these agents can increase the rigidity of the upper materials or affect the material properties (e.g., breathability, wicking, etc.). Moreover, these agents may be subject to delamination over time.

Figure 5B:
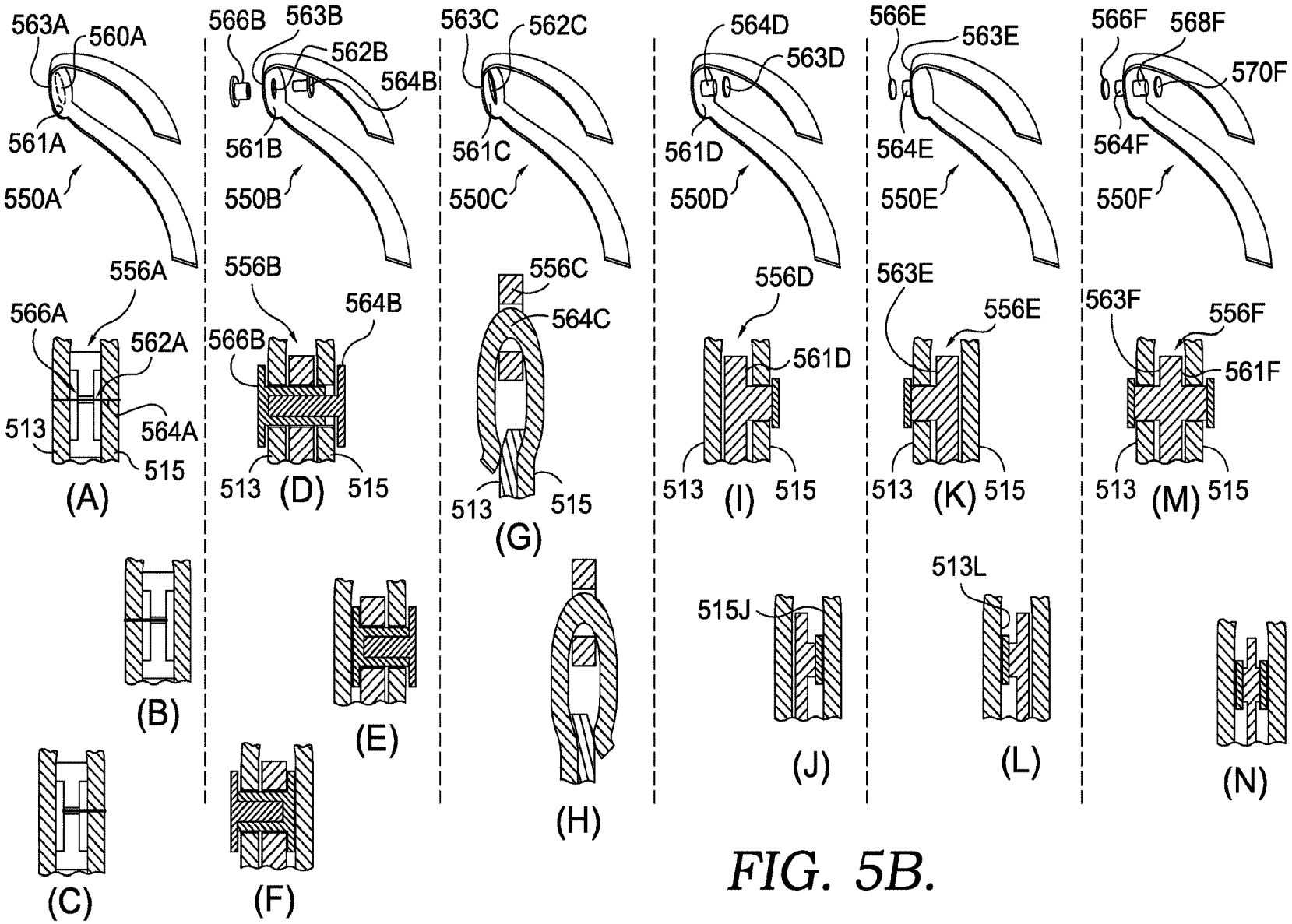
FIG. 5B depicts various couplings that may be used to attach various portions of a collar elevator to an upper in accordance with an aspect of this disclosure.

In one aspect, the collar elevator of the footwear article 510 is affixed to the upper 514 by a mechanical coupling near the center connecting portion 556, and as indicated in FIG. 5A, some alternative collar elevators 550A-F are depicted in FIG. 5B. In an aspect of this disclosure, the footwear article 510 might include any of the collar elevators 550 and 550A-F, or combinations of the features described with respect thereto. It should be noted that, in describing the various collar elevators 550A-F, the connectors a described as being affixed near the center connecting portion, and in other aspects of the disclosure, the connectors described in FIG. 5B might be positioned at a variety of different positions along the lever arms between the center connecting portion and the base.

In one aspect of the disclosure, the footwear article 510 includes a collar elevator having an aperture positioned in the center connecting portion and extending entirely though a thickness of the center connecting portion from an anterior surface (e.g., 561 in FIG. 5A) to a posterior surface (e.g., 563). In addition, the footwear article 510 includes a fastener that extends through the aperture and connects to the inner material layer 515, the outer material layer 513, or both the outer and inner material layers 513 and 515. For example, the fastener may extend though a respective aperture in each of the outer and inner material layers 513 and 515. Examples of collar elevators having an aperture for engaging a fastener are depicted in FIG. 5B as collar elevators 550A-C, and each of these will be described separately in more detail below. In general, each of the fasteners depicted together with the collar elevators 550A-C include some form of elongated member (e.g., thread, stud, tab, and the like) that has a length that is longer than a thickness of at least one of the material layers 513 and/or 515, which contributes to the elongated member's ability to pass from one side of the material layer to the other when operating in a fastening capacity.

Referring now to FIG. 5B, each of the collar elevators 550A-F is depicted, along with a respective cross-sectional view that schematically illustrates various coupling configurations of the collar elevator with the upper 514, including the outer material layer 513 and the inner material layer 515. For example, each cross-sectional view might be taken along a longitudinal midline reference plane at the topline edge of the rear portion of the ankle collar 536 and depicts the center connecting portion of each collar elevator. Alternatively, as described in other portions of this disclosure, the connectors depicted in FIG. 5B might connect a lever arm to an upper, and as such, the cross-sectional views might similarly represent configurations of a lever arm connected to the outer material layer, inner material layer, or both the outer material layer and the inner material layer.

In one aspect of the disclosure, the footwear article 510 includes a collar elevator 550A having a stitch zone 560A having a strand-receiving aperture 562A. The stitch zone 560A includes a region in which one or more stitches 564A are applied to the center connecting portion 556A to couple the center connecting portion 556A to the upper. Furthermore, the stitch zone 560A may include a thinned wall 566A that is easier for a needle to penetrate when applying the stitches 564A (as compared with a thicker wall). The thinned wall may include a recess in the anterior surface 561A of the center connecting portion 556A, a recess in the posterior surface 563A of the center connecting portion 556A, or a recess in both the anterior and posterior surfaces 561A and 563A, as depicted in FIG. 5B. Alternatively, the stitch zone 560A may not include a thinned wall and may include a wall thickness consistent with surrounding portions of the center connecting portion. In FIG. 5B, the stitch 564A is illustrated as extending through the outer material layer 513, the stitch zone 560A, and the inner material layer 515, and this version is designated as version "A" in FIG. 5B. In other aspects of this disclosure, the stitch might extend through only the inner material layer 515 and the stitch zone 560A (see example version "B" in FIG. 5B) or through only the outer material layer 513 and the stitch zone 560A (see example version "C" in FIG. 5B). The strand-receiving aperture 562A may include a preformed aperture that is constructed into the stitch zone 560A prior to insertion of the collar elevator 550A between the outer and inner material layers 513 and 515. Alternatively, the strand-receiving aperture 562A may be formed by a needle passing through the stitch zone 560A when applying the stitch 564A. As mentioned above, although the stitch zone 560A is illustrated along the center connection portion of the collar elevator, in other aspects, a lever arm might include a stitch zone through which a stitch is positioned in order to attach the lever arm to the upper.

In another aspect, the footwear article 510 includes the collar elevator 550B, which includes a connector-receiving aperture 562B that extends entirely through a thickness of the center connecting portion 556B from the anterior surface 561B to the posterior surface 563B and that is configured to receive a connector. For example, the connector may be a discrete, two-part connector having a first part and a second part that snap together, or are otherwise securely fastened to one another. In one aspect, the two-part connector is a male-female connector having a post on one part having a head that securely fits into a recess of the second part. The two parts may be securely fastened to one another in various manners, such as by a frictional engagement (e.g., deformable barbs), snap engagement (e.g., stud and socket), threaded engagement, bonding, heat treating, and any and all combinations thereof. An example two-part connector is depicted in FIG. 5B, including a two-part snap rivet having a first part 564B and a second part 566B. The connector might alternatively be a one-piece connector having a base on one end with a shaft that is inserted though the connector-receiving aperture 562B and formed into a cap, such as a blind rivet. In FIG. 5B, the two-part connector is illustrated as extending through the outer material layer 513, the connector-receiving aperture 562B, and the inner material layer 515, and this version is designated as version "D". In other aspects of this disclosure, the connector might extend through only the inner material layer 515 and the connector-receiving aperture 562B (see example version "E" in FIG. 5B) or through only the outer material layer 513 and the connector-receiving aperture 562B (see example version "F" in FIG. 5B). For purposes of this disclosure, the two-part connector of the collar elevator 550B might be described as "discrete," which is meant to convey that the first part of the connector is not integrally formed with the center connecting portion. "Discrete" might also convey that the first part of the two-part connector is not fixedly attached to a surface of the center connecting portion in a manner intended to prevent removal without affecting the integrity of the center connecting band or the first part. These discrete connectors are in contrast to those described below with respect to 550D-F, in which a part of the connector is pre-joined to a surface of the collar elevator, such as by being integrally formed with the collar elevator or being fixedly attached to a surface of the collar elevator. That is, in 550D-F a first part of the connector is pre-joined to the collar elevator prior to be connected to a second part of the two-part connector. As mentioned above, although the connector-receiving aperture 562B is illustrated along the center connection portion of the collar elevator, in other aspects, a lever arm might include a connector-receiving aperture through which a connector is positioned in order to attach the lever arm to the upper.

In a further aspect of the disclosure, the footwear article 510 includes the collar elevator 550C, which includes an tab-receiving aperture 562C that extends entirely through a thickness of the center connecting portion 556C from the anterior surface 561C to the posterior surface 563C and that is configured to receive a strip of textile material forming a tab and connected to the upper. For example, the tab may be a strip of textile material that is affixed to the upper at a first portion, extends through the tab-receiving aperture 562C, and includes some securing element that impedes the strip from being pulled from, or from slipping though, the tab-receiving aperture. In one example, the tab may pass though the tab-receiving aperture and be affixed onto another portion of the upper at an opposing second portion. An example tab 564C is depicted in FIG. 5B, including a strip of material extending from the anterior side of the center connecting portion 556, through the tab-receiving aperture 562C, and connected back onto the upper. For example, the tab may be stitched on to the upper, welded, tacked, button, snapped, riveted, or otherwise affixed using a coupling after being passed through the tab-receiving aperture 562C. In another example, a distal end of the tab may be coupled with a toggle element, such as a dowel, that is larger than the tab-receiving aperture 562C in at least one dimension and that impedes the strip of material from disconnecting from the tab-receiving aperture 562C. FIG. 5B depicts the tab extending from the anterior side of the center connecting portion and being connected to a surface of the upper that faces away from the foot-receiving cavity, and this version is designated as "G." In other aspects, the tab may extend from the posterior side of the center connecting portion and connect back onto the upper on a surface facing towards the foot-receiving cavity (see example version "H" in FIG. 5B). As mentioned above, although the tab-receiving aperture 562C is illustrated along the center connection portion of the collar elevator, in other aspects, a lever arm might include a tab-receiving aperture through which a tab or material strip extending from the upper is positioned in order to attach the lever arm to the upper.

In another aspect of this disclosure, the footwear article 510 includes a collar elevator having a first part of a two-part connector (e.g., male-female connector) extending from (or located in) the anterior surface (e.g., surface 561 in FIG. 5A), the posterior surface (e.g., surface 563), or both the anterior and posterior surfaces. Examples of collar elevators having a first part of a two-part connector are depicted in FIG. 5B as collar elevators 550D-F, and each of these will be described in more detail below. As briefly explained above, in the collar elevators 550D-F, the first part of the connector is pre-joined to the collar elevator prior to being connected to the second party of the two-part connector.

Describing collar elevators 550D-F in general, the first part of the two-part connector attaches to a second part of the two-part connector in order to couple the center connecting portion to the inner and/or outer material layers. For example, the first part, the second part, or both the first part and the second part may extend through an aperture in the outer and/or inner material layer to connect and form the two-part connector and couple the center connecting portion to the upper. This aspect is similar to some of the fasteners described with respect to collar elevators 550A-C, in which the first part has a length that is longer than a thickness of at least one of the material layers 513 and/or 515, which contributes to the first parts's ability to pass from one side of the material layer to the other when operating in a fastening capacity. Alternatively, one part of the connector may be affixed to the center connecting portion, and the other part of the connector may be affixed to a surface of the upper facing towards the center connecting portion, such that the connector does not pass through an aperture in the upper. The first part of the two-part connector may attach to the second part of the two-part connector in various manners. For example, the first and second part may frictionally engage one another, snap together, threadably attach to one another, clip together, or any and all combinations thereof. Furthermore, the first part of the two-part connector may either be integrally formed with the center connecting portion or may be a discrete connector part that is fixedly attached to the center connecting portion, such as by bonding or adhesive, welding, stitching, thermosetting, and the like. Moreover, in aspects in which the second part of the two-part connector is affixed to a surface of the upper facing towards the center connecting portion, the second part may be affixed to the surface by various couplings, including bonding or adhesive, welding, stitching, thermosetting, and the like.

In one aspect of the disclosure, the footwear article 510 includes the collar elevator 550D (FIG. 5B), which includes a first part 564D of a two-part connector affixed to an anterior surface 561D of the center connecting portion 556D. As described above, the first part 564D may be integrally formed into the anterior surface 561D, or in another aspect may be a discrete connector part pre-joined by some other coupling mechanism (e.g., bonding or adhesive, welding, stitching, thermosetting, etc.) to the anterior surface 561D. The first part 564D connects with a second part 566D of the two-part connector, such as by frictionally engaging one another, snapping together, threadably attaching to one another, clipping together, or any and all combinations thereof. For example, the first part 564D may extend through an aperture in the inner material layer 515 and connect to the second part 566D on a side of the inner material layer 515 facing away from the center connecting portion 556D and towards the foot-receiving cavity 516, and this version is identified by reference letter "I" in FIG. 5B. In an alternative aspect, the second part 566D may be affixed to a surface 515J of the inner material layer 515 facing towards the center connecting portion 556D, and this aspect is identified by reference letter "J" in FIG. 5B. As mentioned above, although the first part 564D of the two-part connector is illustrated along the center connection portion of the collar elevator, in other aspects, an anterior side of a lever arm might include a first part 564D of a two-part connector that attaches to a second part in order to attach the lever arm to the upper.

In another aspect of the disclosure, the footwear article 510 includes the collar elevator 550E, which includes a first part 564E of a two-part connector affixed to a posterior surface 563E of the center connecting portion 556E. As described above, the first part 564E may be integrally formed into the posterior surface 563E, or in another aspect may be a discrete connector part pre-joined by some other coupling mechanism (e.g., bonding or adhesive, welding, stitching, thermosetting, etc.). The first part 564E connects with a second part 566E of the two-part connector, such as by frictionally engaging one another, snapping together, threadably attaching to one another, clipping together, or any and all combinations thereof. For example, the first part 564E may extend through an aperture in the outer material layer 513 and connect to the second part 566E on a side of the outer material layer 513 facing away from the center connecting portion 556E and away from the foot-receiving cavity 516, and this version is identified by reference letter "K" in FIG. 5B. In an alternative aspect, the second part 566E may be affixed to a surface 513L of the outer material layer 513 facing towards the center connecting portion 556E, and this aspect is identified by reference letter "L" in FIG. 5B. As mentioned above, although the first part 564E of the two-part connector is illustrated along the center connection portion of the collar elevator, in other aspects, a posterior side of a lever arm might include a first part 564E of a two-part connector that attaches to a second part in order to attach the lever arm to the upper.

In a further aspect of the disclosure, the footwear article 510 includes the collar elevator 550F, which includes portions of a first two-part connector and a second two-part connector. The first two-part connector includes a first part 564F affixed to a posterior surface 563F of the center connecting portion 556F, and the second two-part connector includes a first part 568F affixed to an anterior surface 561F of the center connecting portion 556F. As described above, the first parts 564F and 568F may be integrally formed into the posterior and anterior surfaces 563F and 561F, or in another aspect may be a discrete connector part pre-joined by some other coupling mechanism (e.g., bonding or adhesive, welding, stitching, thermosetting, etc.). The first part 564F connects with a second part 566F of the two-part connector, and the first part 568F connects with a second part 570F of the two-part connector (e.g., the first parts may connect to respective second parts by frictionally engaging one another, snapping together, threadably attaching to one another, clipping together, or any and all combinations thereof.) For example, the first parts 564F and 568F may extend through respective aperture in the outer and inner material layers 513 and 515 and connect to the second parts 566F and 570F on a side of the outer and inner material layers 513 and 515 facing away from the center connecting portion 556F, and this version is identified by reference letter "M" in FIG. 5B. In an alternative aspect, the second parts 566F and 570F may be affixed to surfaces of the outer and inner material layers 513 and 515 facing towards the center connecting portion 556F, and this aspect is identified by reference letter "N" in FIG. 5B. Although not explicitly illustrated in FIG. 5B, other aspects may include a combination of versions "M" and "N". For example, the first part 564F may extend through an aperture in the outer material layer 513 to connect to the second part 566F, and the other first part 568F may connect to the second part 570F on the surface of the inner material layer 515 facing towards the center connecting portion 556F. Alternatively, the first part 568F may extend through an aperture in the inner material layer 515 to connect to the second part 570F, and the other first part 564F may connect to the second part 566F on the surface of the outer material layer 513 facing towards the center connecting portion 556F. As mentioned above, although the first parts 564F and 568F are illustrated along the center connection portion of the collar elevator, in other aspects, an anterior and posterior side of a lever arm might include first parts in order to attach the lever arm to the upper.

Having described some alternative collar elevators with various connections to the upper, reference is now made back to FIG. 5A to describe additional aspects of the disclosure. As previously described, the collar elevator 550 or 550A-F is inserted between the outer material layer 513 and the inner material layer 515. At that time, the collar elevator 550 or 550A-F may be coupled to the upper using one or more of the couplings describe in the previous portions of this disclosure. In addition, as previously described, the base 558 may have already been attached to the collar elevator 550 or 550A-F (such as when the base 558 is integrally formed with the lever arms), or in some aspects, the base 558 may be attached to the collar elevator 550 or 550A-F after the collar elevator 550 or 550A-F is attached to the upper. In a further aspect, the base 558 is affixed to a sole insert 519, which includes a paper board, cardboard, paper fiber board, or the like. For example, the sole insert 519 may be bonded or adhered to a bottom surface 557 of the base 558 (i.e., the surface facing away from the foot-receiving cavity 516 and towards the sole 512). In one aspect, the coupling to the sole insert 519 impedes the base from lifting when the heel collar is moved from a raised state to a lowered stated.

In a further aspect, the upper 514 includes a skirt 508 positioned at a lower perimeter edge of the upper 514. The skirt 508 may be a continuous portion of the outer material layer 513 that includes the extended length of the skirt 508. Alternatively, the skirt 508 may be a strip of discrete material, such as a low stretch, non-woven material, affixed around a lower perimeter edge of the outer material layer 513. In a further aspect, while the upper 514 is lasted with the collar elevator 550 or 550A-F in position between the layers 513 and 515 and the base 558 and sole insert 519 in position, the skirt 508 is pulled down and coupled to a bottom surface 521 of the sole insert 519. As such, in some aspects, the sole insert 519 may also be referred to as a lasting board. Among other things, this attachment of the skirt 508 to the bottom surface 521 of the sole insert 519 helps form the shape of the upper 514 around the last, and in the heel portion of the skirt 508, attachment to the bottom surface 521 may help to load the collar elevator in a pre-tensed state. Once the skirt 508 is bonded to the bottom surface 521 of the sole insert 519, the sole 512 can be coupled to the skirt 508 and the sole insert 519, and this might be done while the upper is still on the last.

FIGS. 5A and 5B depict one aspect in which one or more structures, such as the skirt 508 and the sole insert 519, are positioned between the base 558 and the sole 512. In an alternative aspect, the base might be positioned differently than the depiction in FIG. 5A. For example, the base might be positioned below a strobel, and reference is now made to FIG. 6A to describe other aspects of this disclosure. FIG. 6A depicts an illustration of a footwear article 610 that is partially deconstructed. That is, an upper 614 is connected to a strobel 608, which is decoupled from a collar elevator 650 and a base 658 (ghosted in broken lines to enhance visibility of the lever arms), which is decoupled from a sole 612. The footwear article 610 is different from the footwear article 510 in that the base 658 is positioned below the strobel 608 when the footwear article 610 is constructed. That is, the base 658 is positioned between the strobel 608 and the sole 612 when the footwear article 610 is constructed. For example, referring briefly to FIG. 6B, a cross-sectional view is presented showing relative positions of a strobel 608 and a base 658, once the footwear article 610 is in a coupled state.

The upper 614 further includes a biteline 623 representing an approximate position of a topline edge 609 of the sole 612, when the sole 612 is connected to the upper 614. In addition, the upper 614 includes the strobel 608, which is coupled to one or more of the material layers of the upper 614, and reference numeral 625 identifies a line along which a strobel stitch or other coupling might be positioned. The strobel 608 is depicted as a continuous panel that entirely closes the bottom portion of the upper 614. In other aspects, the strobel 608 may not be a continuous piece and/or may not close the entire bottom portion, such as a split strobel or a half Strobel.

Furthermore, the upper 614 includes an aperture 627 extending entirely though a first material layer 613 of the upper 614 (i.e., entirely from a first surface facing away from the foot-receiving cavity to a second surface facing towards the foot-receiving cavity), and the aperture 627 provides an opening to a lever-arm region 651 positioned between the first material layer 613 and a more interior second material layer 615. Stated differently, the first material layer 613 might have a thickness with an outward facing surface that faces away from a foot-receiving cavity and/or towards a sole and with an inward facing surface that faces towards the foot-receiving aperture—the thickness being between the outward facing surface and the inward facing surface. In that instance, the aperture 627 extends through material layer from the outward facing surface to the inward facing surface. An aperture might include various structures.

For instance, an aperture might include a slit formed along an edge of the first material layer or a hole formed though the first material layer (e.g., die-cut, punched, punctured, etc.). In other instances, an aperture might include an integrally-formed hole that is constructed by yarn or fiber manipulation in the formation of the first material layer (e.g., knit in, woven in, braided in, etc.). An aperture might have various sizes, measure along at least a portion of a perimeter edge of the aperture (e.g., length, width, circumference, area, etc.,) and in some instances, the size includes a relationship to a collar elevator. For example, an aperture might include a dimension that is at least as big as a portion of a lever arm, in order to permit the lever arm to be positioned in the aperture.

Figure 6B:
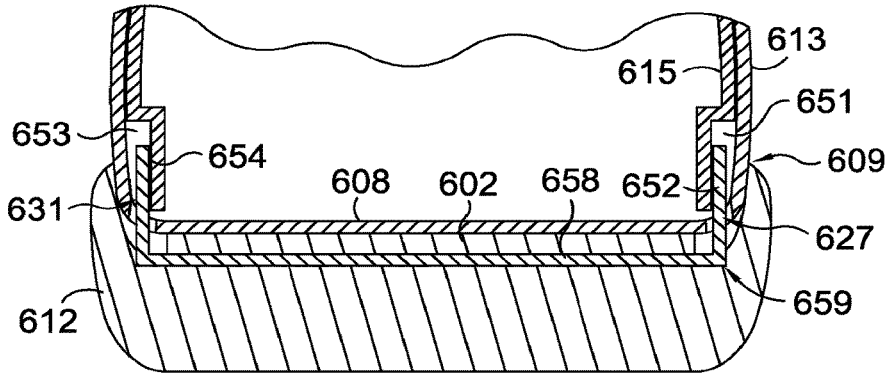
FIG. 6B depicts a cross-sectional view of a portion of the footwear article in FIG. 6A in which the footwear article is at least partially assembled in accordance with an aspect of this disclosure.

Although obscured from view in FIG. 6A, in FIG. 6B the footwear article 610 includes another aperture 631 on the opposing side of the upper that provides an opening to another lever-arm region 653. Generally, if the base 658 is positioned below the strobel 608 (i.e., between the strobel 608 and the sole 612), then a lever arm 652 connected to the base 658 at a junction 659 can extend from the junction 659 through the aperture 627 and into the lever-arm region 651. Again, the cross-sectional view of FIG. 6B depicts the lever arm 652 extending from the junction 659 with the base 658, through the aperture 627, and into the lever-arm region 651. FIG. 6B also depicts the lever arm 654 extending from the base 658, through the aperture 631, and into the lever-arm region 653. As described in other aspects of this disclosure, the connection of the lever arms 652 and 654 to the base 658 at the respective junction (e.g., 659) may include an anchor, such as a frictional-fit coupling, or the lever arms 652 and 654 may be integrally formed with the base 658.

FIGS. 6A and 6B depict examples of some elements of this disclosure, and there are various alternative aspects. For example, the first material layer 613 and the second material layer 615 may include various configurations. Generally, respective to one another, the first material layer 613 is an outer material layer and the second material layer 615 is an inner material layer, and FIGS. 7A-7C depict alternative configurations taken along the reference line 7-7 in FIG. 6A.

In one aspect, the inner material layer 615 may be a liner that extends throughout most of the heel and ankle regions of the upper and that is coupled to the outer material layer 613 at various positions. For example, as depicted in the cross sectional view of FIG. 7A, the inner material layer 715A extends from near the topline edge of the ankle collar to near the strobel stitch 725A, and the inner and outer material layers 713A and 715A are not directly connected to one another in the lever-arm region 751A.

In another aspect depicted by FIG. 7B, the inner material layer 715B may be a liner that extends only along select portions of the inward-facing surface of the outer material layer 713B, such as along the lever-arm region 751B, in order to form an encasement for the lever arm. For example, as depicted in the cross sectional view of FIG. 7B, the inner material layer 715B includes a superior edge that is below the ankle collar, and the inner and outer material layers 713B and 715B are not directly connected to one another along the lever-arm region 751B. Alternatively, the outer material layer might include a smaller panel (relative to the inner material layer) that overlies only a portion of the inner material layer and that extends along a region aligned with the collar elevator to form an outer wall of an encasement, textile sheath, or channel for the lever arms 552 and 554.

In a further aspect, the inner and outer material layers may include a knit-in, lever-arm channel, as depicted in FIG. 7C. For example, the outer material layer 713C and the inner material layer 715C may each include a knit layer integrally formed with one another and detached along the lever-arm region 751C.

Figure 8:
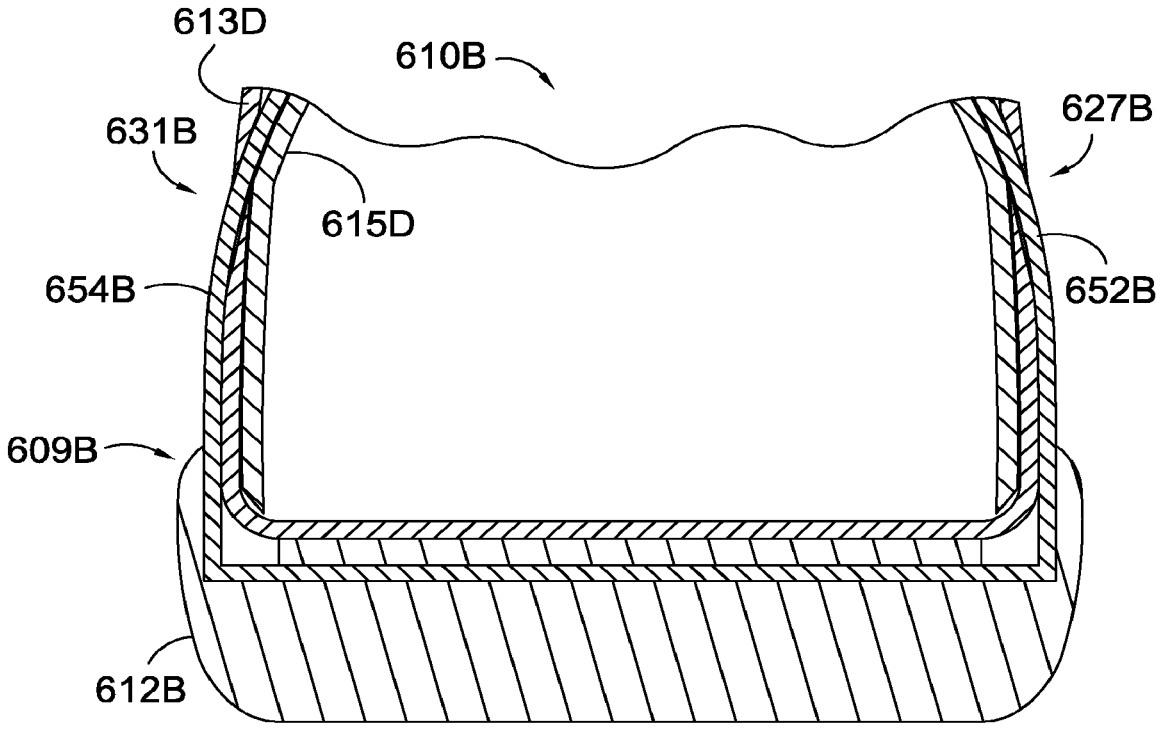
FIG. 8 depicts a cross-sectional view of a portion of a footwear article in accordance with an aspect of this disclosure.

In FIGS. 6A and 6B, the footwear article 610 includes the apertures 627 and 631 positioned below the biteline. As such, the portion of the lever arms that is between the junction with the base and the aperture remains hidden behind a sidewall of the sole 612. In another embodiment, the apertures 627 and 631 might be positioned above the topline edge of the sole 612, such that at least a portion of the lever arms might be exposed before entering the lever-arm regions between the material layers. For example, referring to FIG. 8, an alternative aspect is illustrated, including a footwear article 610B having apertures 627B and 631B positioned above the topline edge 609B of the sole 612B. As such, the lever arms 652B and 654B are exposed on an outside surface prior to entering into a space 651B and 653B between the first material layer 613D and the second material layer 615D.

Referring back to FIGS. 6A and 6B, once the lever arms 652 and 654 are inserted into respective apertures 627 and 631, then the lever arms 652 and 654 may be coupled to the upper 614 in various manners. For example, in one aspect the outer and inner material layers 613 and 615 may be affixed together, such as by stitching, adhesive, welding, and the like, in such a manner to create a lever-arm channel having a size, shape, and volume configured to form fit with the lever arms. In FIG. 6A, the lever arms 652 and 654 generally taper from the junction with the base 658 to a distal end, and as such, each lever-arm channel might similarly taper from the aperture (e.g., 627 and 631) to a distal end. In one aspect, the fit between the lever arms and the lever-arm channel is sufficient transfer forces between the collar elevator and the upper when the ankle collar is moved between the raised and lowered states.

In other aspects, the lever arms 652 and 654 might attach to the upper by way of one or more of the connectors described with respect to FIG. 5B. That is, each lever arm 652 and 654 might include an aperture through which a connector extends, including a stitch, a discrete two-part connector, or a textile tab. Alternatively, each lever arm 652 and 654 might include a pre-joined, first part of a two-part connector, which attaches to a second part of the two-part on the outside or inside surface of the outer and/or inner material layers.

Figure 9A:
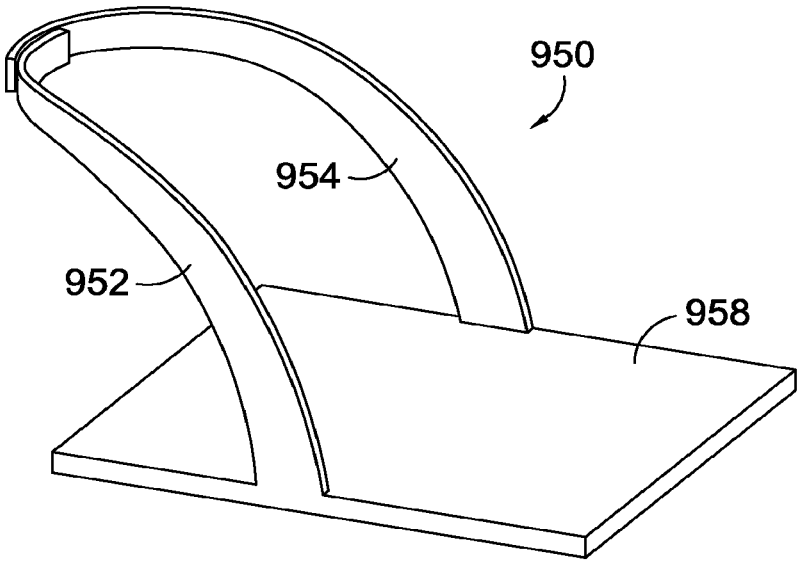
FIGS. 9A-9D depict various alternative collar elevators in accordance with an aspect of this disclosure.

FIG. 6A depicts one aspect in which the footwear article 610 includes two lever arms 652 and 654, each of which terminates prior to extending around the back of the ankle region 626. Referring to FIG. 9A, in an alternative aspect, the footwear article 610 includes a collar elevator 950 having a first lever arm 952 and a second lever arm 954 and each lever arm 952 and 954 extends around at least a portion of the rear of the ankle region (i.e., at least to the longitudinal midline reference plane). As such, the lever arms 952 and 954 at least partially overlap with one another. In FIG. 9A, the lever arms 952 and 954 are depicted in a curved configuration, as they might appear when the collar is in a raised state, but prior to insertion into the apertures 627 and 631 the lever arms might be straight to allow for smoother insertion. In that case, the flexibility of the lever arms 952 and 954 may allow the lever arms 952 and 954 to be guided into the configuration depicted in FIG. 9A by the lever arm channel(s) that communicate with the apertures 627 and 631. The collar elevator 950 may be affixed to the upper 610 by any of the above described connectors, including a form-fit channel, stitching, discrete two-part connector(s), a connector having one part pre-joined to the collar elevator, and any and all combinations thereof. The first and second lever arms 952 and 954 might be integrally formed with the base 958 or might be formed as discrete elements that are affixed to the base 958 using one or more anchors.

Figure 9B:
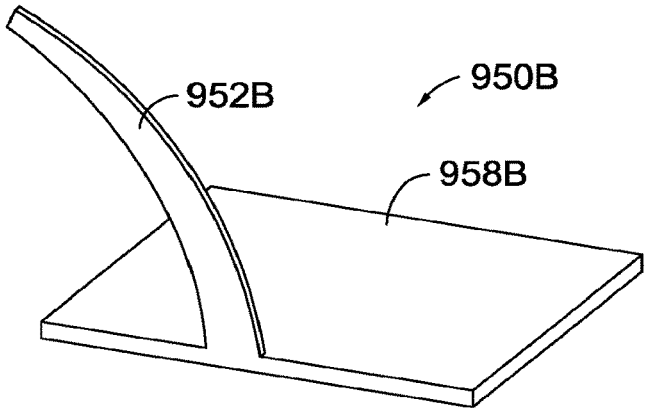
Figure 9C:
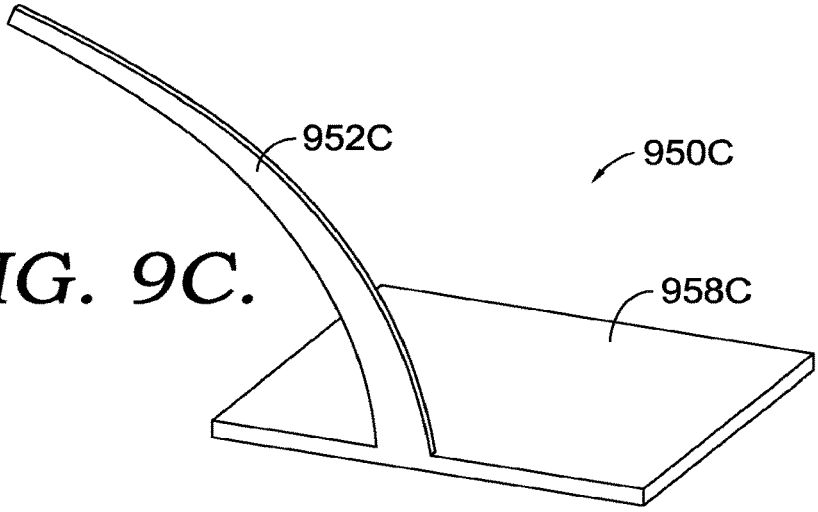
Figure 9D:
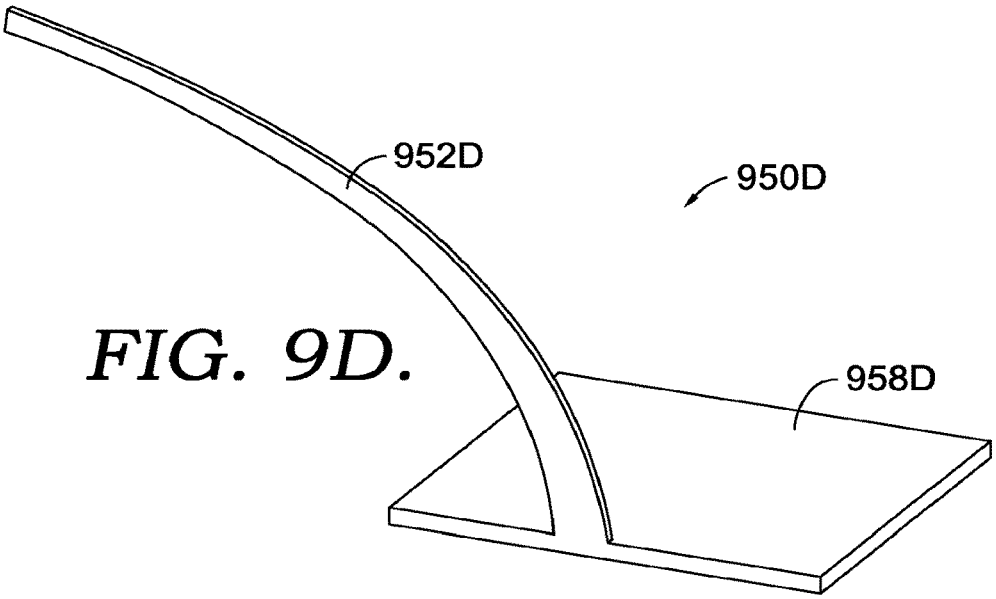

In FIGS. 6A and 9A, the collar elevators include a first lever arm and a second lever arm. Referring now to FIGS. 9B-9D, alternative aspects are depicted in which the collar elevator of the footwear article 610 might include a single lever arm 952B-D. For example, with the single lever arm 952B-D affixed to the base 958B-D, the single lever arm may be positioned in the aperture 627 or in the aperture 631 and extend to various positions in the heel and/or ankle regions, depending on a length of the lever arm. The lever arm 952B includes a length configured to arrange the lever arm only on the medial side or only on the lateral side of the footwear article 610. For example, if the aperture 627 is on the medial side, then the lever arm 952B would extend from the base 958B, though the aperture 627, and to a terminal endpoint that is medial relative to a longitudinal midline reference plane. Alternatively, if the aperture 627 is on the lateral side, then the lever arm 952B would extend from the base 958B, though the aperture 627, and to a terminal endpoint that is lateral relative to a longitudinal midline reference plane.

Referring to FIG. 9C, the lever arm 952C is longer than the lever arm 952B, and if the aperture 627 is on the medial side, then the lever arm 952C would extend from the base 958C, though the aperture 627, and to a terminal endpoint that is lateral relative to a longitudinal midline reference plane. Alternatively, if the aperture 627 is on the lateral side, then the lever arm 952C would extend from the base 958C, though the aperture 627, and to a terminal endpoint that is medial relative to a longitudinal midline reference plane. Referring to FIG. 9D, the lever arm 952D is longer than the lever arm 952C, and if the aperture 627 is on the medial side, then the lever arm 952D would extend from the base 958D, though the aperture 627, around the rear of the ankle region, and possibly through the aperture 631 on the opposing, lateral side of the upper. Alternatively, if the aperture 627 is on the lateral side, then the lever arm 952D would extend from the base 958C, though the aperture 627, around the rear of the ankle region, and possibly through the aperture 631 on the opposing, medial side of the upper.

Once the lever arms 952B-D are positioned within the upper, the lever arms 952B-D may be coupled to the upper 614 in various manners. For example, in one aspect the outer and inner material layers may be affixed together, such as by stitching, adhesive, welding, and the like, in such a manner to create a lever-arm channel having a size, shape, and volume configured to form fit with the lever arms. In FIGS. 9B-D, the lever arms 952B-D generally taper from the junction with the base to a distal end, and as such, each lever-arm channel might similarly taper from the aperture to a distal end. In one aspect, the fit between the lever arms and the lever-arm channel is sufficient transfer forces between the collar elevator and the upper when the ankle collar is moved between the raised and lowered states.

In other aspects, the lever arms 952B-D might attach to the upper by way of one or more of the connectors described with respect to FIG. 5B. That is, each lever arm 952B-D might include an aperture through which a connector extends, including a stitch, a discrete two-part connector, or a textile tab. Alternatively, each lever arm 952B-D might include a pre-joined, first part of a two-part connector, which attaches to a second part of the two-part on the outside or inside surface of the outer and/or inner material layers.

In another aspect of the present disclosure, the collar elevators 550 and 550A-F might be inserted into the upper 610 in such a manner that the lever arms are positioned in the apertures 627 and 631. As such, in these aspects, the base 558 would be positioned below the strobel 608.

Several different aspects included above in this disclosure have described a variety of different collar elevators having a base positioned below strobel. This structuring and configuration might contribute to various advantages in certain contexts. For example, arranging the base below the strobel may reduce the need for a sole insert, and may provide a configuration suitable for strobel lasting. In some instances, the sole insert may provide unwanted rigidity underneath the foot, and in that case, the strobel is often a less rigid solution. In addition, strobel lasting may be more efficient than board lasting from a manufacturing perspective, in some situations, since board lasting includes a step for pulling down the skirt and affixing to a bottom surface of the sole insert. Furthermore, by omitting the sole insert, the base may be positioned directly on top of the sole, such as on the midsole, which may provide an opportunity for the base to connect to, or be anchored in, the sole.

Figure 10A:
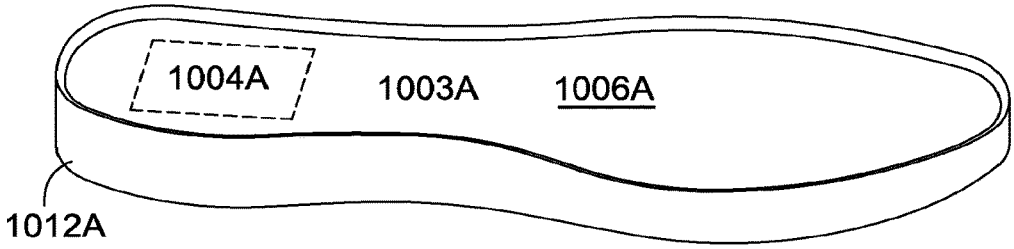
FIGS. 10A-10C depict various alternative soles in accordance with an aspect of this disclosure.
Figure 10B:
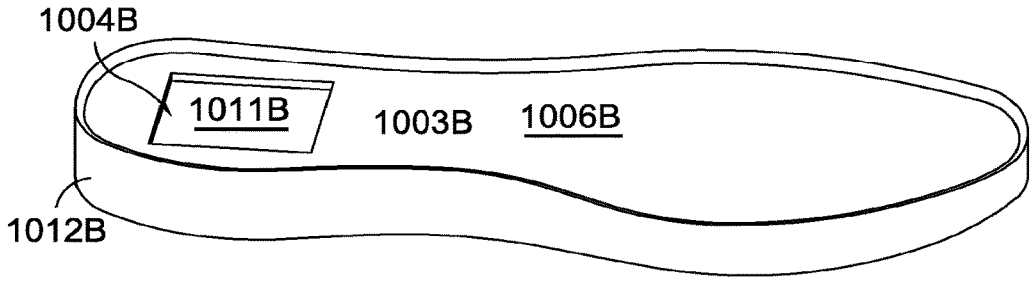
Figure 10C:
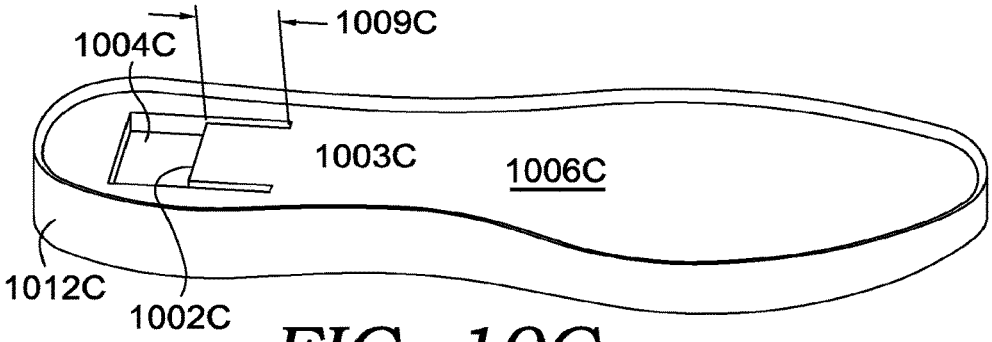

Referring now to FIGS. 10A-10C, various soles 1012A-C are depicted that might be included in the footwear article 610 and that might be combined with any of the previously described collar elevators 550, 550A-F, 650, 950, and 950B-D. For example, FIG. 10A depicts a sole 1012A having a superior surface 1006A that, when included in the footwear article 610, faces towards the base and towards the foot-receiving cavity 618. A dashed line in FIG. 10A represents a base-attachment zone illustrating an approximate position at which a base might be attached to the superior surface 1006A. As indicated in other portions of this disclosure, the superior surface 1006A might be attached to the base prior to the base either before or after the base is attached to the collar elevator and coupled to the upper. The superior surface 1006A includes a base-target region 1004A enclosed within the base-attachment zone and a perimeter region 1003A around the base-target region 1004A. In an aspect of the disclosure, the superior surface 1006A smoothly transitions from the base-target region 1004A to the perimeter region 1003A. Stated another way, a portion of the base-target region 1004A and a portion of the perimeter region 1003A that are directly adjacent to one another extend in a substantially same plane. Stated yet another way, the base-target region 1004A is not recessed or raised relative to the perimeter region 1003A. The size and shape of the base and base-target region 1004A are merely one example, and in other aspects, the size and shape may be customized to fit the shape of the sole 1012A. For example, the size of the base may be customized to substantially fill out the width of the surface 1006A, as well as the heelward depth, and filling out these portions of the upper may avoid hot spots or irritation points in the footbed. Furthermore, a thickness of the base may gradually taper as the base extends towards its anterior edge in order to smoothly transition to the surface 1006A.

Referring to FIG. 10B, another sole 1012B is illustrated, and the sole 1012B includes a base-docking recess 1004B included in the superior surface 1006B. The base-docking recess 1004B includes a depth extending from a floor 1011B of the recess up to the perimeter region 1003B. In an aspect of the disclosure the depth of the base-docking recess 1004 is substantially similar to a thickness of the base, which is measured from a base bottom surface facing towards the sole to a base top surface facing towards the foot-receiving cavity, and an example of base thickness 690 is depicted in FIG. 6A. As such, when the base is affixed in the base-docking recess 1004B, the base top surface is substantially flush with the perimeter region 1003B of the surface 1006B. For example, the base may be bonded, adhered, welded, thermoset, or co-molded into the base-docking recess 1004B. Among other things, a similar base thickness and recess depth may reduce the presence of potential irritation spots in the footbed. In addition, the base size and shape is more customizable, since it the sides and back of the upper may not need to be filled out. Furthermore, the walls of the base-docking recess 1004B may help maintain a position of the base by impeding the base from rotating relative to the sole 1012B. More specifically, in one aspect a perimeter edge of a bottom surface of the base forms a 2D shape that is substantially similar to a 2D shape formed by a perimeter edge of a floor 1011B of the base-docking recess. For example, in FIG. 10B the perimeter edge of the floor 1011B of the base-docking recess 1004B includes a 2D shape that is rectangular, and the bottom-surface perimeter edge of any of the other collar elevators described in this disclosure may include a substantially similar rectangular 2D shape. In this sense, the perimeter edge of the floor and the perimeter edge of the base bottom surface may cooperate in a lock-and-key type relationship to help reduce or impede rotation of the base when nested in the base-docking recess. Moreover, a consistent base size and shape may be usable across different shaped soles, provided a corresponding base-docking recess 1004B is included in the various different soles.

Figure 10D:
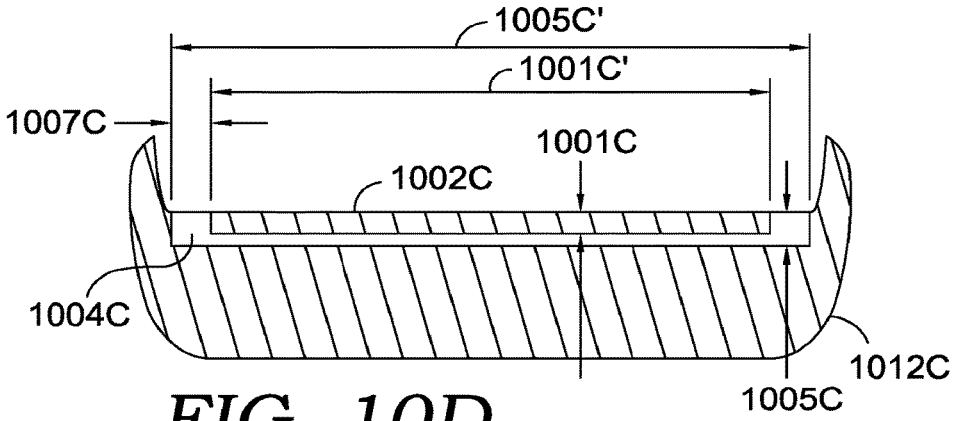
FIG. 10D depicts a cross-sectional view of the sole depicted in FIG. 10C in accordance with an aspect of this disclosure.

Referring now to FIGS. 10C and 10D, in another aspect the footwear article 610 includes the sole 1012C. The sole 1012C is similar to the sole 1012B, since the sole 1012C also includes a base-docking recess 1004C. The base-docking recess 1004C may also have a floor with a perimeter edge that forms a 2D shape substantially similar to the perimeter edge of the bottom surface of the base. However, the sole 1012C also includes a base-retention tab 1002C, which fits on top of the base once the base has been positioned in the base-docking recess 1004C. The base-retention tab 1002C may include various elements. For example, in one aspect, the base-retention tab 1002C includes a thickness 1001C (see e.g., FIG. 10D) that, when combined with the thickness of the base (e.g., thickness 690 in FIG. 6A), is substantially similar to a depth 1005C of the base-docking recess 1004C. In addition, the tab 1002C includes a medial-to-lateral width 1001C' that is shorter than a medial-to-lateral width 1005C' of the base-docking recess 1004C. As such, a gap 1007C is formed between the medial and lateral sides of the tab 1002C and the medial and lateral sides of the base-docking recess 1004C. The gaps provide a fit feature, which allows the lever arms to extend unimpeded out of the base-docking recess 1004C when the base is affixed therein. In addition, the gap allows the tab 1002C to fit flush against the top surface of the base without potential interference from the lever arms.

The tab 1002C may operate in various manners. For example, in one aspect, the tab 1002C provides an additional securing element to retain the base within the base-docking recess 1004C. In addition, the tab 1002C may provide some amount of cushioning over the base, which may sometimes be a more rigid material. Furthermore, the tab 1002C may operate to hold the anterior edge of the base down when the ankle collar is pushed into a lowered state, which in turn creates tension in the collar elevator. In this sense, the tab 1002C may have a variety of lengths that are operational to help hold the anterior edge of the base down. In FIG. 10C, the tab 1002C includes a length 1009C measured from an anterior joint between the tab and the rest of the sole to a posterior, free edge of the tab 1002C. In addition, the base includes a base length (e.g., length 692 in FIG. 6A) extending from a front edge of the base to a rear edge of the base, and as described above, the base length may be substantially similar to the length of the base-docking recess 1004C. In one aspect, the tab length is equal to or less than the base length. In another aspect, the tab length is equal to or less than 75% of the base length. In a further aspect, the tab length is equal to or less than 50% of the base length. Additionally, the tab length may be equal to or less than 25% of the base length. Moreover, the tab length might be equal to or less than 10% of the base length, and still operate to impede the anterior edge of the base from lifting when the ankle collar is moved to a lowered state. As explained with respect to the sole 1012B, the base may be affixed in the base-docking recess 1004C in various manners. For example, the base may be bonded, adhered, welded, thermoset, co-molded, or any combination thereof, into the base-docking recess 1004C, or the sole 1012C might be overmolded around the base with the lever arms extending through the gaps.

Figure 11A:
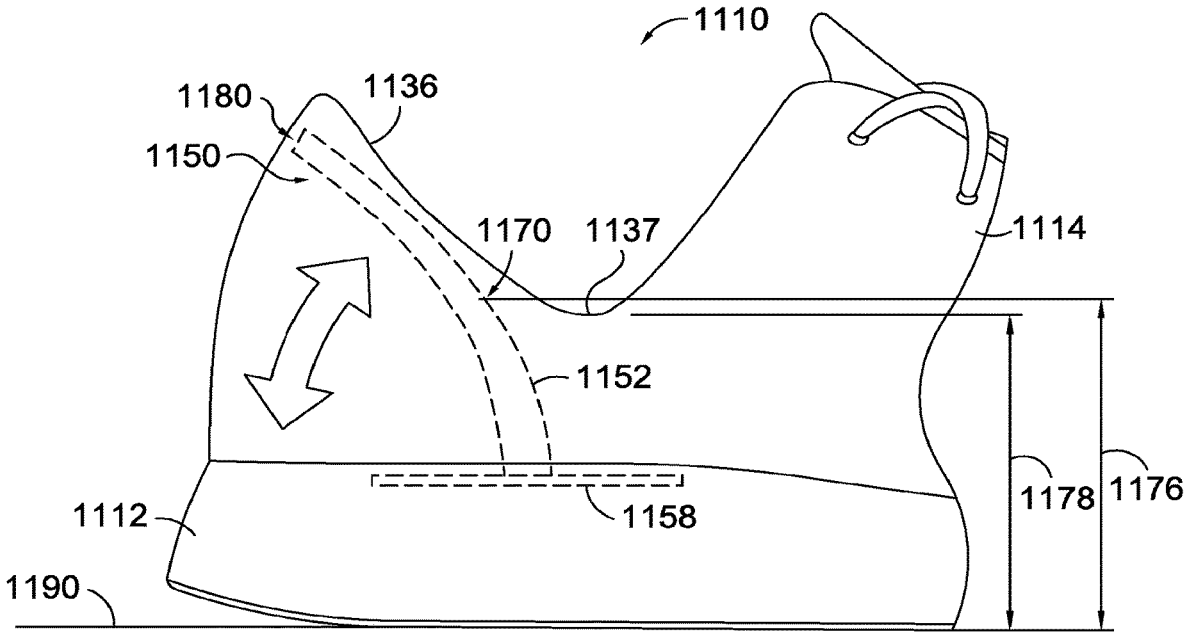
FIGS. 11A and 11B depict another alternative footwear article in accordance with an aspect of this disclosure.
Figure 11B:
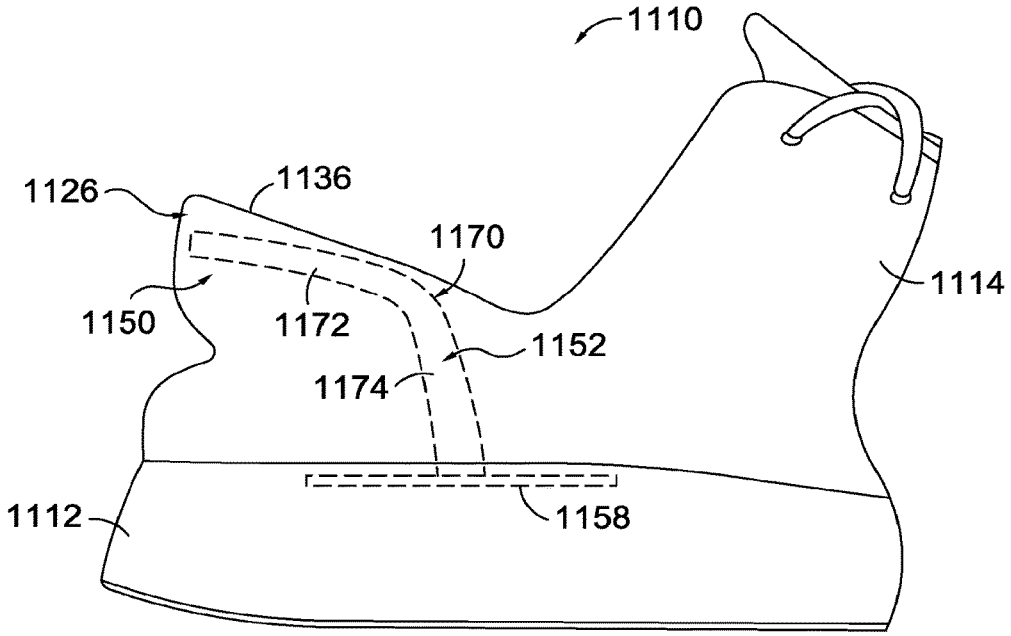

Referring now to FIGS. 11A and 11B, another aspect is illustrated that might be included in one or both footwear articles 510 and 610. In FIGS. 11A and 11B, a portion of a footwear article 1110 is depicted and the footwear article 1110 includes a sole 1112 and an upper 1114 coupled to the sole 1112 and comprising an ankle collar 1136 that is movable between a lowered state (i.e., FIG. 11B) positioned closer to the sole 1112 and a raised state (i.e., FIG. 11A) positioned farther from the sole. In addition, the footwear article 1110 includes a collar elevator 1150 operable to return the ankle collar 1136 from the lowered state to the raised state. The collar elevator 1150 includes a base 1158 that might be layered above a strobel or sole insert (such as in FIG. 5A), or below a strobel (such as in FIG. 6A). In addition, the collar elevator might include any of the collar elevators 550, 550A-F, 650, 950, or 950B-D.

In a further aspect, the collar elevator 1150 includes a lever arm 1152 that flexes rearwardly, downwardly, or both rearwardly and downwardly as the ankle collar 1136 is moved from the raised state to the lowered state. Various attributes might contribute to the manner in which the lever arm 1152 flexes, such as the cross section(s) of the lever arm, sizes of the lever arm, shape(s) of the lever arm, recesses or notches in the lever arm, and the like. In some instances, the downward force causing the ankle collar 1136 to move to a lowered state may be distributed fairly evenly along the length of the lever arm, and as such, the lever arm may adjust rearwardly and/or downwardly in a relatively linear and consistent manner. Stated another way, the portion of the collar elevator 1150 that is most distal 1180 from the base 1158 might adjust, move, or flex a largest distance; the portion of the collar elevator closest to the base 1158 might adjust, move, or flex a shortest distance; and the distances moved by portions of the collar elevator 1150 between the base 1158 and the distal end 1180 gradually and consistently increase in a linear manner from the base to the distal end 1180.

Alternatively, the lever arm 1152 may include one or more deflection points that separate a more superior segment of the lever arm from a more inferior portion of the lever arm, the more inferior portion being closer to the base (as measured along the length of the lever arm). The one or more deflection points represent a position at which the superior segment adjusts exponentially more than the inferior segment when the ankle collar is moved from the raised state to the lowered state. For example, the deflection point may include a position at which the lever arm hinges or pivots to permit the superior segment to adjust downwardly at a faster rate that the inferior portion, when the ankle collar 1136 is moved from the raised state to the lowered state. A deflection point may be detected or identified under various circumstances. For example, in one aspect the ankle collar may be moved from a first state having a first distance from the sole to a second state having a second distance from the sole, the second distance being shorter than the first distance, and the deflection point may be portion of the lever arm at which the lever arm bends or folds to a greater extent than one or more other portions of the lever arm. The second distance may be less than or equal to 25% of the first distance, less than or equal to 50% of the first distance, or less than or equal to 75 percent of the first distance.

Referring to FIG. 11B, the lever arm 1152 includes a deflection point 1170 positioned between a superior segment 1172 of the lever arm and an inferior segment 1174 of the lever arm, the inferior segment 1174 being closer to the base 1158 that the deflection point 1170 or the superior segment 1172 (as measured along the length of the lever arm). In one aspect, footwear article 1110 includes a distance 1176 (FIG. 11A) between the deflection point 1170 and a horizontal reference plane 1190, which generally includes the plane of a relatively flat ground surface on which the ground-contacting surface rests with the footwear article 1110 being stationary, in an at-rest state. Various elements may contribute to a position of the deflection point 1170. For example, the deflection point may include a thinner cross section or a notch. In addition, the attachment of the collar elevator 1150 to the upper 1114 might limit rearward travel, which could cause the lever arm to bend more at the deflection point when moved from the raised state to the lowered state.

With continued reference to FIGS. 11A and 11B, the ankle collar 1136 includes a topline edge having an inferior-most portion 1137 that is anterior to the deflection point 1170 (i.e., closer to the forefoot of the footwear article 1110). In addition, the footwear article 1110 includes a height 1178 between the inferior-most portion 1137 and the horizontal reference plane 1190. In an aspect of this disclosure, the height 1178 is less than the distance 1176. Among other things, the shorter height of the inferior-most portion 1137 of the ankle collar 1136, together with the anterior positioning (relative to the deflection point 1170) acts as a hinge or pivot point for the rear portions of the ankle region 1126. As such, the rear portions of the ankle collar 1136 may pull to a lesser extent on the more forward portions of the ankle collar 1136 when the ankle collar 1136 is moved to a lowered state (as compared to other footwear articles having a higher ankle collar). In addition, this alternative configuration may allow for smaller goring elements, gussets, or elastic panels, to be used along the ankle collar 1136, or may be utilized in lieu of any goring element, gusset, or elastic panel.

The side depicted in FIGS. 11A and 11B might be the medial side or the lateral side, and the other side of the footwear article 1110 may include similar features. However, in some aspects, the opposing side that is obstructed from view in FIGS. 11A and 11B might also not include corresponding features, such as where the opposing side does not includes a corresponding lever arm (e.g., collar elevators 950B and 950C).

From the foregoing, it will be seen that this invention is one well adapted to attain all the ends and objects hereinabove set forth together with other advantages which would be realized by an ordinary skilled artisan and which are inherent to the structure. It will be understood that certain features and subcombinations are of utility and may be employed without reference to other features and subcombinations. This is contemplated by and is within the scope of the claims. Since many possible aspects may be made of the invention without departing from the scope thereof, it is to be understood that all matter herein set forth or shown in the accompanying drawings is to be interpreted as illustrative and not in a limiting sense.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

The following clauses are aspects contemplated herein. The listing is merely specific examples and is not limiting to the scope of the current Specification. Instead, the following clauses are intended to provide guidance as to some of the contemplated aspects herein. As used herein, and in connection with the clauses listed hereinafter, the terminology "any of clauses" or similar variations of said terminology is intended to be interpreted such that features of clauses may be combined in any combination. For instance, interpretation of the phrase "the footwear article of clause x-y" as used hereinafter should be interpreted as the footwear article of any one or combination of clause x through clause y, where x and y are numerical clauses. That is, an exemplary clause 4 may indicate the method/apparatus of any of clauses 1 through 3, which is intended to be interpreted such that features of clause 1 and clause 4 may be combined; elements of clause 2 and clause 4 may be combined; elements of clause 3 and 4 may be combined; elements of clauses 1, 2, and 4 may be combined; elements of clauses 2, 3, and 4 may be combined; elements of clauses 1, 2, 3, and 4 may be combined; and/or other variations. Further, the terminology "any of clauses" or similar variations of said terminology is intended to include "any one of clauses" or other variations of such terminology, as indicated by some of the examples provided above.

Clause 1: A footwear article comprising: a sole; an upper coupled to the sole and comprising an ankle collar that is movable between a lowered state positioned closer to the sole and a raised state positioned farther from the sole, wherein the upper comprises a material layer that at least partially overlaps with the sole and that includes an outward facing surface facing towards the sole and an inward facing surface facing away from the sole and towards a foot-receiving cavity, and wherein the material layer comprises an aperture extending through material layer from the outward facing surface to the inward facing surface; and a collar elevator operable to return the ankle collar from the lowered state to the raised state, the collar elevator having a base positioned between the outward facing surface and the sole and a lever arm connected to the base at a junction and extending from the junction through the aperture.

Clause 2: The footwear article of clause 1, wherein the material layer that at least partially overlaps with the sole is a portion of an outer material layer of the upper; wherein the upper further comprises an inner material layer that is closer to the foot-receiving cavity than the outer material layer; and wherein the lever arm is positioned between the outer material layer and the inner material layer after the lever arm extends from the junction and through the aperture.

Clause 3. The footwear article of clause 2, wherein the inner material layer is an inner liner.

Clause 4. The footwear article of clause 2, wherein the inner material layer and the outer material layer are opposing sides of a lever-arm tubular encasement that houses the lever arm.

Clause 5. The footwear article of clause 4, wherein the inner material layer and the outer material layer are knit layers, and wherein the lever-arm tubular encasement is integrally knit.

Clause 6. The footwear article of any of clauses 1-5, wherein the aperture is on a medial side of the upper.

Clause 7. The footwear article of clause 6, wherein at least a portion of the aperture is below a biteline, which includes an interface between a topline edge of the sole and the upper.

Clause 8. The footwear article of clause 6, wherein at least a portion of the aperture is above a biteline, which includes an interface between a topline edge of the sole and the upper.

Clause 9. The footwear article of any of clauses 1-8, wherein the lever arm extends upwards from the base, through the aperture, and towards a rear of an ankle region of the upper.

Clause 10. The footwear article of clause 9, wherein the lever arm terminates on the medial side of the upper and at a terminal end opposite the base.

Clause 11. The footwear article of clause 9, wherein the lever arm wraps around the rear of the ankle region of the upper and terminates on a lateral side of the upper at a terminal end opposite the base.

Clause 12. The footwear article of any of clauses 1-11, wherein the aperture is a medial-side aperture and the lever arm is a medial-side lever arm, and wherein the footwear article further comprises: a lateral-side aperture extending through the material layer on a lateral side of the upper; and a lateral-side lever arm connected to the base at another junction and extending from the other junction through the lateral-side aperture.

Clause 13. The footwear article of clause 12, wherein at least a portion of the medial-side aperture and at least a portion of the lateral-side aperture are below a biteline, which includes an interface between a topline edge of the sole and the upper.

Clause 14. The footwear article of clause 12, wherein at least a portion of the medial-side aperture and at least a portion of the lateral-side aperture are above a biteline, which includes an interface between a topline edge of the sole and the upper.

Clause 15. The footwear article of clause 12, wherein the medial-side lever arm and the lateral-side lever arm both extend upwards from the base, through a respective aperture, and towards a rear of an ankle region of the upper.

Clause 16. The footwear article of clause 15, wherein the medial-side lever arm terminates on the medial side of the upper at a terminal end opposite the base, and wherein the lateral-side lever arm terminates on the lateral side of the upper at a terminal end opposite the base.

Clause 17. The footwear article of clause 15, wherein the medial-side lever arm and the lateral-side lever arm are coupled to one another in the rear of the ankle region.

Clause 18. The footwear article of clause 17, wherein the medial-side lever arm and the lateral-side lever arm are connected to one another by a center connecting portion, which is positioned in the rear of the ankle region.

Clause 19. The footwear article of clause 17, wherein the medial-side lever arm, the lateral-side lever arm, and the center connecting portion are continuous.

Clause 20. The footwear article of clause 17, wherein the medial-side lever arm and the lateral-side lever arm overlap with one another in the rear of the ankle region.

Clause 21. The footwear article of clause 17, wherein the medial-side lever arm and the lateral-side lever arm are coupled to the upper in the rear portion of the ankle region.

Clause 22. The footwear article of any of clauses 1-5, wherein the aperture is on a lateral side of the upper.

Clause 23. The footwear article of clause 22, wherein the lever arm extends upwards from the base, through the aperture, and towards a rear of an ankle region of the upper.

Clause 24. The footwear article of clause 23, wherein the lever arm terminates on the lateral side of the upper and at a terminal end opposite the base.

Clause 25. The footwear article of clause 23, wherein the lever arm wraps around the rear of the ankle region of the upper and terminates on a medial side of the upper at a terminal end opposite the base.

Clause 26. A footwear article comprising: a sole; an upper coupled to the sole and comprising an ankle collar that is movable between a lowered state positioned closer to the sole and a raised state positioned farther from the sole; a collar elevator operable to return the ankle collar from the lowered state to the raised state, the collar elevator comprising a base and at least one lever arm, wherein the base is positioned below a strobel, such that the base is positioned between the strobel and the sole and includes a top surface facing towards the strobel; and a base-docking recess included in a top surface of the sole facing towards the base of the collar elevator, wherein the base is positioned in the base-docking recess.

Clause 27. The footwear article of clause 26, wherein the sole includes a tab that at least partially covers the top surface of the base positioned in the base-docking recess.

Clause 28. The footwear article of clause 27, wherein the tab includes a tab width in the medial-to-lateral direction and the recess includes a recess width in the medial-to-lateral direction; wherein the tab width is less than the recess width, such that a medial edge and lateral edge of the tab are spaced inward of a medial edge and lateral edge of the recess; and wherein the at least one lever arm is positioned between the medial edge of the tab and the medial edge of the recess or between the lateral edge of the tab and the lateral edge of the recess.

Clause 29. The footwear article of clause 28, wherein the at least one lever arm extends from a junction with the base, between the medial edges or between the lateral edges, and through an aperture in a material layer of the upper to a position that is between the material layer and a foot-receiving cavity.

Clause 30. The footwear article of clause 28, wherein the at least one lever arm extends from a junction with the base, between the medial edges or between the lateral edges, and along an outward facing surface of a material layer of the upper.

Clause 31. The footwear article of any of clauses 27-30, wherein the tab includes a tab length measured from a front edge of the tab to a rear edge of the tab; wherein the base includes a base length extending from a front edge of the base to a rear edge of the base; and wherein the tab length is equal to or less than the base length.

Clause 32. The footwear article of clause 29, wherein the tab length is equal to or less than 75% of the base length.

Clause 33. The footwear article of clause 30, wherein the tab length is equal to or less than 50% of the base length.

Clause 34. The footwear article of clause 31, wherein the tab length is equal to or less than 25% of the base length.

Clause 35. The footwear article of clause 32, wherein the tab length is equal to or less than 10% of the base length.

Clause 36. The footwear article of any of clauses 27-35, wherein a combination of a thickness of the tab and a thickness of the base is substantially similar to a depth of the base-docking recess.

Clause 37. The footwear article of any of clauses 26-36, wherein a perimeter edge of a bottom surface of the base forms a 2D shape that is substantially similar to a 2D shape formed by a perimeter edge of a floor of the base-docking recess.

Clause 38. The footwear article of clause 26, wherein a thickness of the base is substantially similar to a thickness of the base-docking recess.

Clause 39. A footwear article comprising: a sole; an upper coupled to the sole and comprising an ankle collar that is movable between a lowered state positioned closer to the sole and a raised state positioned farther from the sole, wherein the ankle collar includes a topline edge having an inferior-most portion along a medial side or a lateral side, and wherein the inferior-most portion is spaced a first distance apart from a horizontal reference plane; and a collar elevator operable to return the ankle collar from the lowered state to the raised state, the collar elevator comprising at least one lever arm that is on a same side as the inferior most portion and that has a deflection point positioned between a superior segment of the lever arm and an inferior segment of the lever arm, wherein the deflection point is spaced a second distance apart from the horizontal reference plane and the second distance is larger than the first distance.

Clause 40. The footwear article of clause 39, wherein the inferior-most edge is positioned more anterior relative to the deflection point.

Clause 41. The footwear article of any of clause 39-40, wherein the collar elevator includes a base positioned above a sole insert.

Clause 42. The footwear article of any of clauses 39-41, wherein the collar elevator includes a medial-side lever arm without a corresponding lever arm on a lateral side.

Clause 43. The footwear article of any of clauses 39-41, wherein the collar elevator includes a lateral-side lever arm without a corresponding lever arm on a medial side.

Clause 44. The footwear article of any of clauses 39-41, wherein the at least one lever arm is a medial-side lever arm and wherein the collar elevator further comprises a lateral-side lever arm.

Clause 45. A footwear article comprising: a sole; an upper coupled to the sole and comprising an ankle collar that is movable between a lowered state positioned closer to the sole and a raised state positioned farther from the sole, wherein the upper includes a skirt affixed to a bottom surface of a sole insert, and wherein the upper includes a first aperture extending through a thickness of a material layer; a collar elevator operable to return the ankle collar from the lowered state to the raised state, the collar elevator comprising a base and one or more lever arms, wherein the base is affixed to a top surface of the sole insert, such that the sole insert is positioned between the base and the sole, and wherein the collar elevator includes a second aperture extending entirely through a thickness; and a connector extending through the first aperture and the second aperture.

Clause 46. The footwear article of clause 45, wherein the second aperture is positioned in the one or more lever arms.

Clause 47. The footwear article of clause 45, wherein the collar elevator further comprises a center connecting portion, and wherein the second aperture is positioned in the center connecting portion.

Clause 48. The footwear article of any of clauses 45-47, wherein the connector is a segment of yarn forming a stitch, and wherein the segment is positioned in the first aperture and the second aperture.

Clause 49. The footwear article of any of clauses 45-47, wherein the connector is a two-part connector having one or more posts that extend through the first aperture and the second aperture.

Clause 50. The footwear article of any of clauses 45-47, wherein the connector is a two-part snap rivet.

Clause 51. The footwear article of any of clauses 45-50, wherein the material layer is an outer material layer, and wherein the collar elevator is positioned between the outer material layer and a foot-receiving cavity.

Clause 52. The footwear article of any of clauses 45-50, wherein the material layer is an inner material layer, and wherein the inner material layer is positioned between the collar elevator and a foot-receiving cavity.

Clause 53. The footwear article of clause 45, wherein the upper further comprises another material layer having a third aperture, and wherein the connector also extends through the third aperture.

Clause 54. The footwear article of clause 53, wherein the material layer is an outer material layer and the other material layer is an inner material layer, and wherein the collar elevator is positioned between the outer and inner material layers.

Clause 55. The footwear article of clause 53, wherein the material layer is an inner material layer and the other material layer is an outer material layer, and wherein the collar elevator is positioned between the outer and inner material layers.

Clause 56. A footwear article comprising: a sole; an upper coupled to the sole and comprising an ankle collar that is movable between a lowered state positioned closer to the sole and a raised state positioned farther from the sole, wherein the upper includes a skirt affixed to a bottom surface of a sole insert, and wherein the upper includes a first aperture extending entirely from a first side of the material layer to a second side of the material layer; a collar elevator operable to return the ankle collar from the lowered state to the raised state, the collar elevator comprising a base and one or more lever arms, wherein the base is affixed to a top surface of the sole insert, such that the sole insert is positioned between the base and the sole, and wherein the collar elevator is positioned on the first side of the material layer and includes first part of a two-part connector extending from a surface of the collar elevator and through the first aperture; and a second part of the two-part connector positioned on the second side of the material layer and coupled to the first part of the two-part connector.

Clause 57. The footwear article of clause 56, wherein the first part of the connector extends from a surface of a lever arm.

Clause 58. The footwear article of clause 57, wherein the surface faces towards a foot-receiving cavity, and wherein the material layer is positioned between the surface and the foot-receiving cavity.

Clause 59. The footwear article of clause 57, wherein the surface faces away from a foot-receiving cavity, and wherein the lever arm is positioned between the material layer and the foot-receiving cavity.

Clause 60. The footwear article of clause 56, wherein the collar elevator further comprises a center connecting portion, and wherein the first part of the connector extends from a surface of the center connecting portion.

Clause 61. The footwear article of clause 60, wherein the surface faces towards a foot-receiving cavity, and wherein the material layer is positioned between the surface and the foot-receiving cavity.

Clause 62. The footwear article of clause 60, wherein the surface faces away from a foot-receiving cavity, and wherein the center connecting portion is positioned between the material layer and the foot-receiving cavity.

Clause 63. The footwear article of any of clauses 56-62, wherein the first part and the second part snap together.

Clause 64. The footwear article of any of clauses 56-62, wherein the first part and the second part frictionally engage one another.

Clause 65. The footwear article of any of clauses 56-62, wherein the first part and the second part threadably engage one another.

Clause 66. The footwear article of clause 56, wherein the upper further comprises another material layer having a second aperture, and wherein the collar elevator includes another first part of another two-part connector extending from an opposing surface of the collar elevator and through the second aperture.

Clause 67. The footwear article of clause 66, wherein the material layer is an outer material layer and the other material layer is an inner material layer, and wherein the collar elevator is positioned between the outer and inner material layers.

Clause 68. The footwear article of clause 66, wherein the material layer is an inner material layer and the other material layer is an outer material layer, and wherein the collar elevator is positioned between the outer and inner material layers.

The invention claimed is:

1. A method for manufacturing a footwear article, the method comprising:

coupling a lever arm of a collar elevator to a material layer of a footwear upper;

securing the footwear upper to a last with the lever arm coupled to the footwear upper;

attaching a base of the collar elevator directly to the lever arm, while the footwear upper is secured to the last;

wherein the base is directly affixed to a sole insert; and wherein the sole insert is a lasting board.

2. The method of claim 1, wherein:

the method further comprises securing a lower perimeter edge of the footwear upper to an underneath side of the sole insert, while the footwear upper is secured to the last.

3. The method of claim 2 further comprising, affixing a midsole to the underneath side of the sole insert.

4. The method of claim 2 further comprising, affixing a midsole to the lower perimeter edge of the footwear upper, such that the lower perimeter edge is layered between a footwear sole and the sole insert.

5. The method of claim 2, wherein the sole insert comprises a paper board material.

6. The method of claim 1, wherein:

the material layer is an outer material layer;

the method further comprises inserting the lever arm between the outer material layer and an inner material layer; and the lever arm is positioned between the inner material layer and the outer material layer when the footwear upper is secured to the last.

7. The method of claim 1, wherein:

the lever arm is a medial-side lever arm;

the method further comprises, before securing the footwear upper to the last, coupling a lateral-side lever arm to the footwear upper.

8. The method of claim 1, wherein at least a stitch attaches the collar elevator to the footwear upper.

9. The method of claim 1 further comprising an anchor, wherein the base is attached to the lever arm by the anchor, which fits into an anchor-shaped receptacle on the base.

* * * * *